US011432627B2

(12) United States Patent
Tung

(10) Patent No.: US 11,432,627 B2
(45) Date of Patent: Sep. 6, 2022

(54) SUNSHADE SWITCHABLE BETWEEN AN ELECTRIC MODE AND A MANUAL MODE

(71) Applicant: Benson Tung, Kaohsiung (TW)

(72) Inventor: Benson Tung, Kaohsiung (TW)

( * ) Notice: Subject to any disclaimer, the term of this patent is extended or adjusted under 35 U.S.C. 154(b) by 144 days.

(21) Appl. No.: 17/099,892

(22) Filed: Nov. 17, 2020

(65) Prior Publication Data

US 2022/0151349 A1 May 19, 2022

(51) Int. Cl.
*A45B 25/14* (2006.01)

(52) U.S. Cl.
CPC ..... *A45B 25/14* (2013.01)

(58) Field of Classification Search
CPC ..... A45B 25/14
See application file for complete search history.

(56) References Cited

U.S. PATENT DOCUMENTS 2,960,094 A * 11/1960 Small ..... A45B 25/14 135/37
3,311,119 A * 3/1967 Pearlstine ..... A45B 17/00 135/20.3
6,182,917 B1 * 2/2001 Lai ..... A45B 25/14 242/395
7,406,976 B1 * 8/2008 Chan ..... A45B 25/14 135/20.1
7,562,666 B2 * 7/2009 Chan ..... A45B 25/143 242/395
8,522,804 B1 * 9/2013 Tung ..... A45B 25/14 135/20.1
8,534,304 B1 * 9/2013 Tung ..... A45B 17/00 135/20.1
8,763,620 B1 * 7/2014 Tung ..... A45B 17/00 135/20.1
10,064,465 B2 * 9/2018 Pan ..... A45B 25/14

* cited by examiner

*Primary Examiner* — Noah Chandler Hawk
(74) *Attorney, Agent, or Firm* — Alan D. Kamrath; Karin L. Williams; Mayer & Williams PC

(57) ABSTRACT

A sunshade switchable between a manual mode and an electric mode includes an operating device having a shaft. A driven gear is rotatably coupled to the shaft. A driving gear for electric mode is rotatable in unison with the shaft. A runner interlocks with the shaft. The shaft is movable to couple with the driven gear for electric mode or the driving gear for manual mode. When the driven gear for electric mode is coupled with the shaft, a motor can be used to move the runner for folding, unfolding, tilting, or straightening the sunshade. When the driving gear for manual mode is coupled with the shaft, a handle can be operated to move the runner for folding, unfolding, tilting, or straightening the sunshade.

11 Claims, 16 Drawing Sheets

SUNSHADE SWITCHABLE BETWEEN AN ELECTRIC MODE AND A MANUAL MODE

BACKGROUND OF THE INVENTION

The present invention relates to a sunshade driven by a screw rod and, more particularly, to a sunshade that can be switched between an electric mode and a manual mode for controlling folding, unfolding, and tilting of a canopy of the sunshade for shielding from the sunlight.

Outdoor sunshades can provide a large-area sunlight shielding effect. Operation of a typical outdoor sunshade is substantially the same as a manual one. Namely, when a runner moves upwards towards a hub, a canopy is stretched open by a plurality of ribs. On the other hand, when the runner moves downwards away from the hub, the canopy is folded. Such an outdoor sunshade is bulky and is relatively high, leading to inconvenience to manual operation of the runner along the pole. Thus, an operating device is disposed on the pole and includes a handle that can be manually operated to unfold or fold the canopy. The manual operating device provides a labor saving effect but is time-consuming. Thus, an electric operating device is proposed to activate a motor for controlling unfolding or folding of the canopy. However, operation of the motor requires electricity which is generally provided by batteries. When the batteries run out of power, the canopy of the electric sunshade cannot be unfolded or folded.

BRIEF SUMMARY OF THE INVENTION

In a first aspect, the present invention provides a sunshade switchable between a manual mode and an electric mode. The sunshade comprises:

a pole including upper and lower ends spaced from each other along a longitudinal axis of the pole;

a hub securely mounted to the upper end of the pole, wherein a plurality of ribs is pivotably mounted to the hub;

a runner slideably mounted around the pole, wherein a plurality of stretchers is pivotably mounted between the runner and the plurality of ribs, wherein the plurality of ribs moves away from the pole to an unfolded position when the runner moves towards the hub, and wherein the plurality of ribs moves towards the pole to a collapsed position when the runner moves away from the hub;

a motor coupled to the lower end of the pole and configured to drive a driving gear;

a screw rod interlocked with the runner, wherein the screw rod includes a connecting end coupled to an actuating gear, and wherein rotation of the screw rod moves the runner towards or away from the hub;

a driven gear for electric mode movably and rotatably mounted between the actuating gear and the driving gear;

a driving gear for manual mode movably and rotatably mounted between the actuating gear and the driving gear;

a handle interlocked with the driving gear for manual mode, wherein when the sunshade is set to the electric mode, the driven gear for electric mode meshes with the actuating gear and the driving gear, the driving gear for manual mode is disengaged from the actuating gear, rotation of the motor causes movement of the runner along the longitudinal axis of the pole, and the runner is not moved when the handle rotates, and wherein when the sunshade is set to the manual mode, the driving gear for manual mode meshes with the actuating gear, the runner is not moved when the motor operates, and wherein rotation of the handle causes movement of the runner along the longitudinal axis of the pole.

The operating device can be switched between the electric mode and the manual mode. When the battery has sufficient power, the motor can be used to easily fold, unfold, tilt, or straighten the sunshade. On the other hand, when the battery has insufficient power, the sunshade can be manually operated to fold, unfold, tilt, or straighten the sunshade.

In an example, the sunshade further comprises a shaft rotatably mounted between the actuating gear and the driving gear. The shaft includes an interlocking end. The driven gear for electric mode is rotatably mounted to the shaft. The handle is coupled to the interlocking end of the shaft. When the sunshade is set to the electric mode and the motor operates, the driven gear for electric mode rotates about an axial direction of the shaft, and the shaft and the driving gear for manual mode are not moved. When the sunshade is set to the manual mode and the handle is rotated, the shaft and the driving gear for manual mode rotate jointly, and the driven gear for electric mode is not moved.

In an example, the sunshade further comprises:

a return spring biasing the shaft to a position corresponding to the manual mode;

an insertion member for electric mode slidably mounted around the shaft, wherein the shaft includes an engaging groove for electric mode and an engaging groove for manual mode;

an insertion member for manual mode slidably mounted around the shaft, wherein when the sunshade is set to the electric mode, the engaging groove for electric mode engages with the insertion member for electric mode, and wherein when the sunshade is set to the manual mode, the engaging groove for manual mode engages with the insertion member for manual mode.

In an example, the shaft includes a pressing end spaced from the interlocking end and an intermediate section between the engaging groove for electric mode and the engaging groove for manual mode. The engaging groove for manual mode is adjacent to the pressing end. A flange is formed on the intermediate section. The driving gear for manual mode and the driven gear for electric mode are formed on the intermediate section. The driven gear for electric mode is retrained between the flange and the driving gear for manual mode in the axial direction of the shaft. The shaft, the driven gear for electric mode, and the driving gear for manual mode move jointly in the axial direction of the shaft.

In an example, the sunshade further comprises:

a canopy angle adjusting device mounted between the hub and the upper end of the pole, wherein the canopy angle adjusting device includes a pivotable member pivotable between a first position and a second position, wherein when the pivotable member is in the first position, the pivotable member and the runner are parallel to the pole, and wherein when the pivotable member is in the second position, the pivotable member and the runner are not parallel to the pole;

a base;

a coupling member coupled above the base;

an inner casing fixed to and rotatable in unison with the lower end of the pole, wherein the inner casing is rotatably coupled to the coupling member, wherein the motor, the driving gear for manual mode, the driven gear for electric mode, and the actuating gear are received in the inner casing;

a push and rotate member mounted around the inner casing and slidable along the longitudinal axis of the pole;

a positioning ring non-rotatably mounted to the coupling member; and a follower ring rotatably coupled to the coupling member and slidable along the longitudinal axis of the pole, wherein the follower ring interlocks with the push and rotate member, wherein when the follower ring engages with the positioning ring, the pole is prevented from rotating about the longitudinal axis of the pole, wherein when the push and rotate member moves along the longitudinal axis of the pole to disengage the follower ring and the positioning ring, the pole is rotatable about the longitudinal axis of the pole.

In an example, the sunshade further comprises a pressing spring mounted to the coupling member and configured to bias the follower ring to engage with the positioning ring. The sunshade further comprises a connecting ring mounted between the push and rotate member and the follower ring. The connecting ring is non-rotatably coupled to the inner casing. The push and rotate member presses against the connecting ring to move the follower ring.

In an example, the sunshade further comprises an outer casing in which the coupling member is rotatably mounted. A battery cover is detachably mounted to the outer casing and receives a battery for supplying electricity to the motor for operation. The coupling member includes a rotation connection portion and a coupling end extending from the rotation connection portion. The coupling end is coupled to the base. The rotation connection portion includes a sleeve portion formed at a distal end thereof and defining a space. The pressing spring, the follower ring, and the connecting ring are coupled to the sleeve portion. A portion of the inner casing is rotatably received in the space. The outer casing is in rotatable connection with the rotation connection portion and is jointly rotatable with the inner casing. The handle is located outside of the outer casing.

In an example, the sunshade further comprises:

a switch button for manual mode interlocked with the insertion member for electric mode, wherein the inner casing includes a shaft coupling portion extending in a radial direction of the pole, wherein the inner casing further includes a first groove defined in an inner periphery of the shaft coupling portion and located corresponding to the engaging groove for electric mode, the inner casing further includes a second groove defined in the inner periphery of the shaft coupling portion and located corresponding to the engaging groove for manual mode, wherein the inner casing further includes a first sliding groove extending from the outer periphery thereof to the shaft coupling portion and located corresponding to the first groove and a second sliding groove coaxial to the shaft coupling portion, wherein the shaft is in rotatable connection with the shaft coupling portion, wherein the insertion member for electric mode is movable received in the first groove, wherein the insertion member is movably received in the second groove, and wherein the switch button for manual mode is movable received in the first sliding groove; and a switch button for electric mode, wherein the shaft further includes a pressing end spaced from the interlocking end, wherein a spacing between the engaging groove for manual mode and the pressing end is smaller than a spacing between the engaging groove for electric mode and the pressing end, wherein the switch button for electric mode interlocks with the pressing end of the shaft and is movably received in the second sliding groove.

In a second aspect, the present invention provides a sunshade switchable between a manual mode and an electric mode. The sunshade comprises:

a pole including upper and lower ends spaced from each other along a longitudinal axis of the pole;

a hub securely mounted to the upper end of the pole, wherein a plurality of ribs is pivotably mounted to the hub;

a runner slidably mounted around the pole, wherein a plurality of stretchers is pivotably mounted between the runner and the plurality of ribs, wherein the plurality of ribs moves away from the pole to an unfolded position when the runner moves towards the hub, and wherein the plurality of ribs moves towards the pole to a collapsed position when the runner moves away from the hub; and an operating device coupled to the lower end of the pole, wherein the operating device interlocks with the runner and includes a motor and a handle, wherein when the operating device is set to the electric mode, the rotation of the motor causes movement of the runner along the longitudinal axis of the pole, and the runner is not moved when the handle rotates, and wherein when the operating device is set to the manual mode, the runner is not moved when the motor operates, and wherein rotation of the handle causes movement of the runner along the longitudinal axis of the pole.

In an example, the sunshade further comprises:

a canopy angle adjusting device mounted between the hub and the upper end of the pole, wherein the canopy angle adjusting device includes a pivotable member pivotable between a first position and a second position, wherein when the pivotable member is in the first position, the pivotable member and the runner are parallel to the pole, and wherein when the pivotable member is in the second position, the pivotable member and the runner are not parallel to the pole;

a base; and a coupling member fixed above the base;

wherein the operating device includes:

an inner casing coupled to and rotatable in unison with the lower end of the pole, wherein the inner casing is rotatably coupled to the coupling member;

a push and rotate member mounted around the inner casing and slidable along the longitudinal axis of the pole;

a positioning ring non-rotatably mounted to the coupling member;

a follower ring rotatably coupled to the coupling member and slidable along the longitudinal axis of the pole, wherein the follower ring interlocks with the push and rotate member, wherein when the follower ring engages with the positioning ring, the pole is prevented from rotating about the longitudinal axis of the pole, wherein when the push and rotate member moves along the longitudinal axis of the pole to disengage the follower ring and the positioning ring, the pole is rotatable about the longitudinal axis of the pole.

In an example, the operating device further includes:

a pressing spring mounted to the coupling member and configured to bias the follower ring to engage with the positioning ring; and a connecting ring mounted between the push and rotate member and the follower ring, wherein the connecting ring is non-rotatably coupled to the inner casing, and wherein the push and rotate member presses against the connecting ring to move the follower ring.

In an example, the sunshade further comprises an outer casing in which the coupling member is rotatably mounted. A battery cover is detachably mounted to the outer casing and receives a battery for supplying electricity to the motor for operation. The coupling member includes a rotation connection portion and a coupling end extending from the rotation connection portion. The coupling end is coupled to the base. The rotation connection portion includes a sleeve portion formed at a distal end thereof and defining a space. The pressing spring, the follower ring, and the connecting ring are coupled to the sleeve portion. A portion of the inner casing is rotatably received in the space. The outer casing is in rotatable connection with the rotation connection portion and is jointly rotatable with the inner casing. The handle is located outside of the outer casing.

The present invention will become clearer in light of the following detailed description of illustrative embodiments of this invention described in connection with the drawings.

Figure 1:
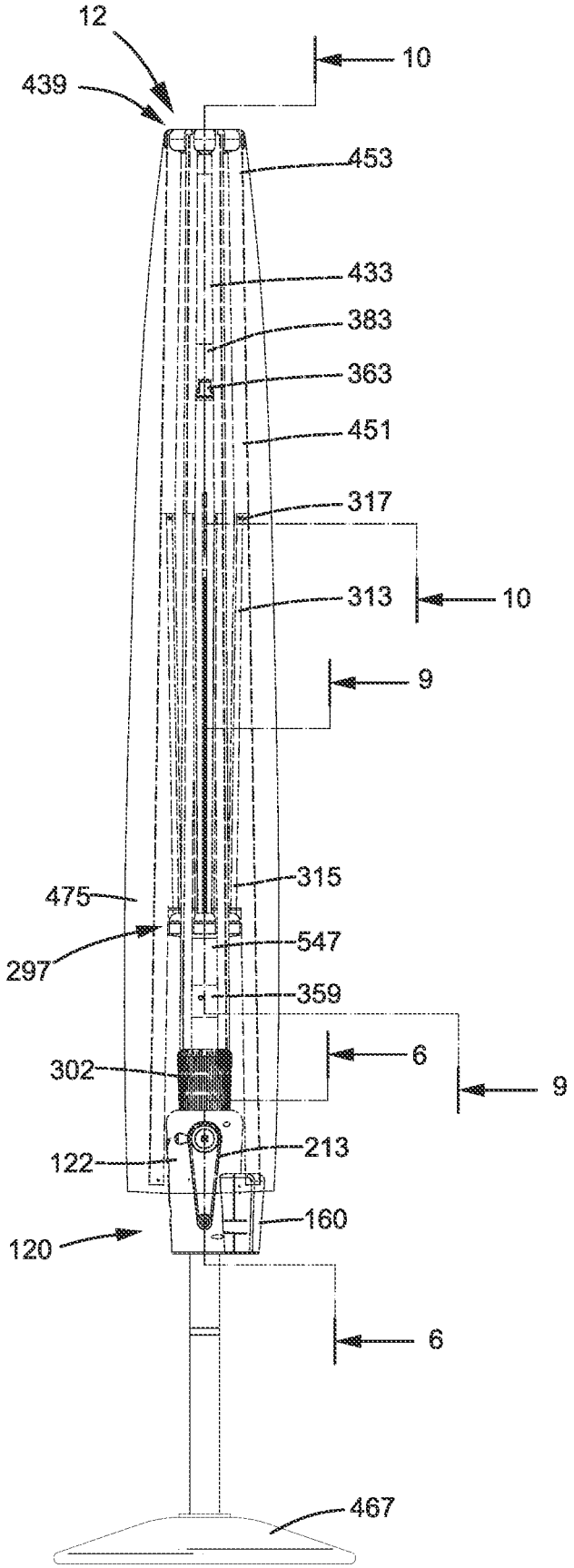
FIG. 1 is a side elevational view of a sunshade according to the present invention, with the sunshade in a folded state.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "top", "bottom", "end", "portion", "section", "longitudinal", "lateral", "radial", "annular", "spacing", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
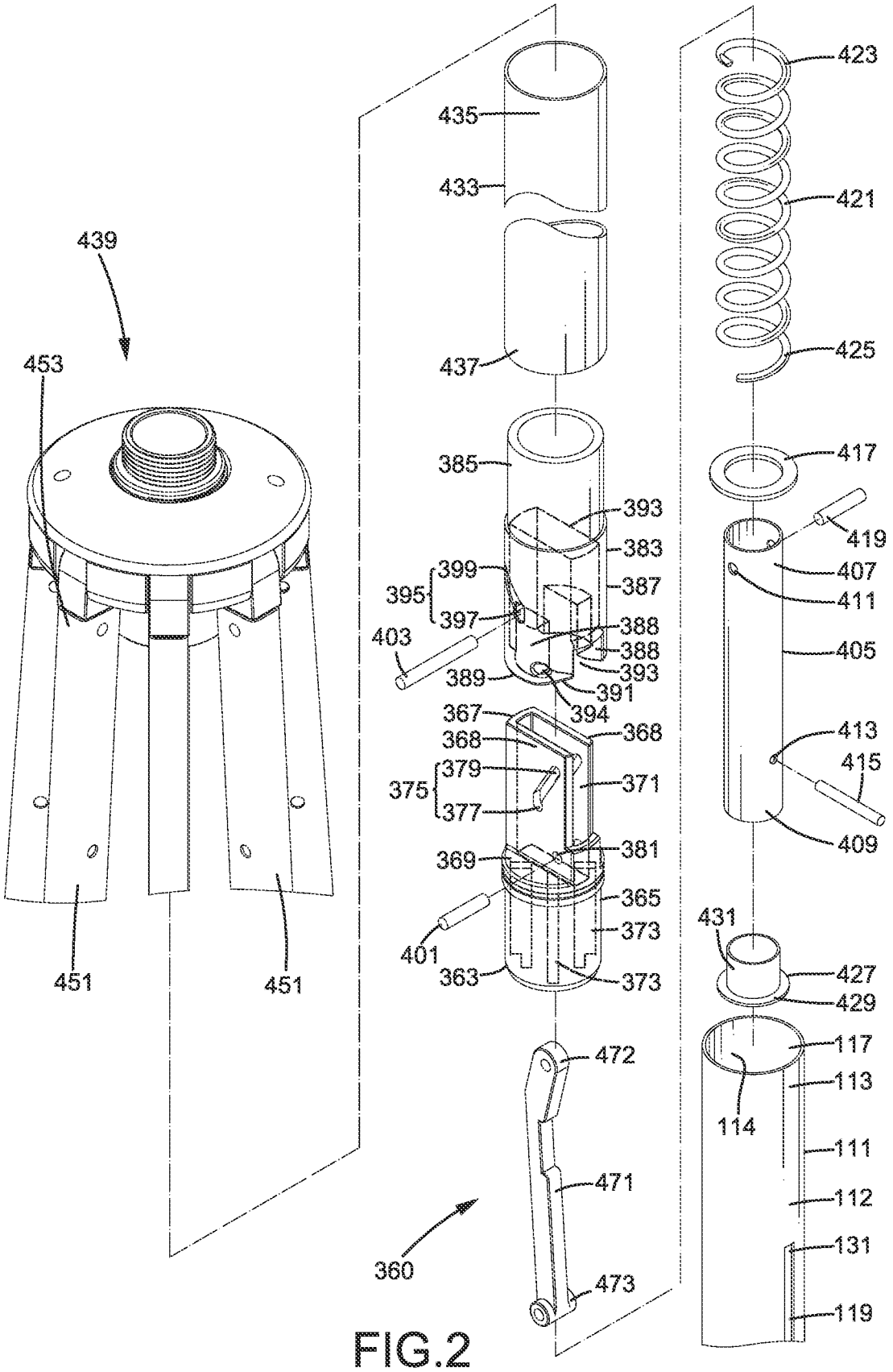
FIG. 2 is an exploded, perspective view illustrating components adjacent to a hub of the sunshade of FIG. 1.
Figure 3:
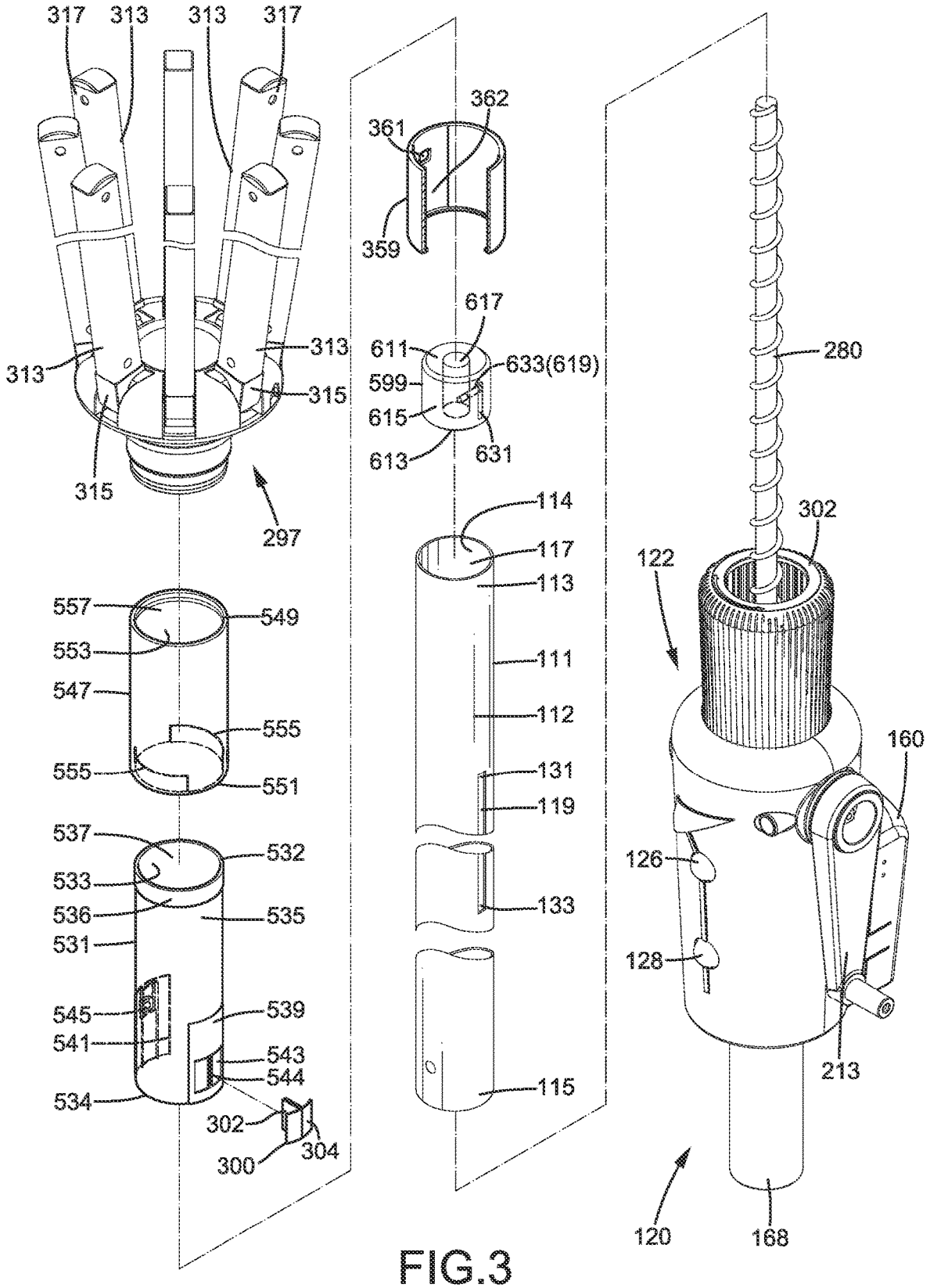
FIG. 3 is an exploded, perspective view illustrating components adjacent to a runner of the sunshade of FIG. 1.
Figure 4:
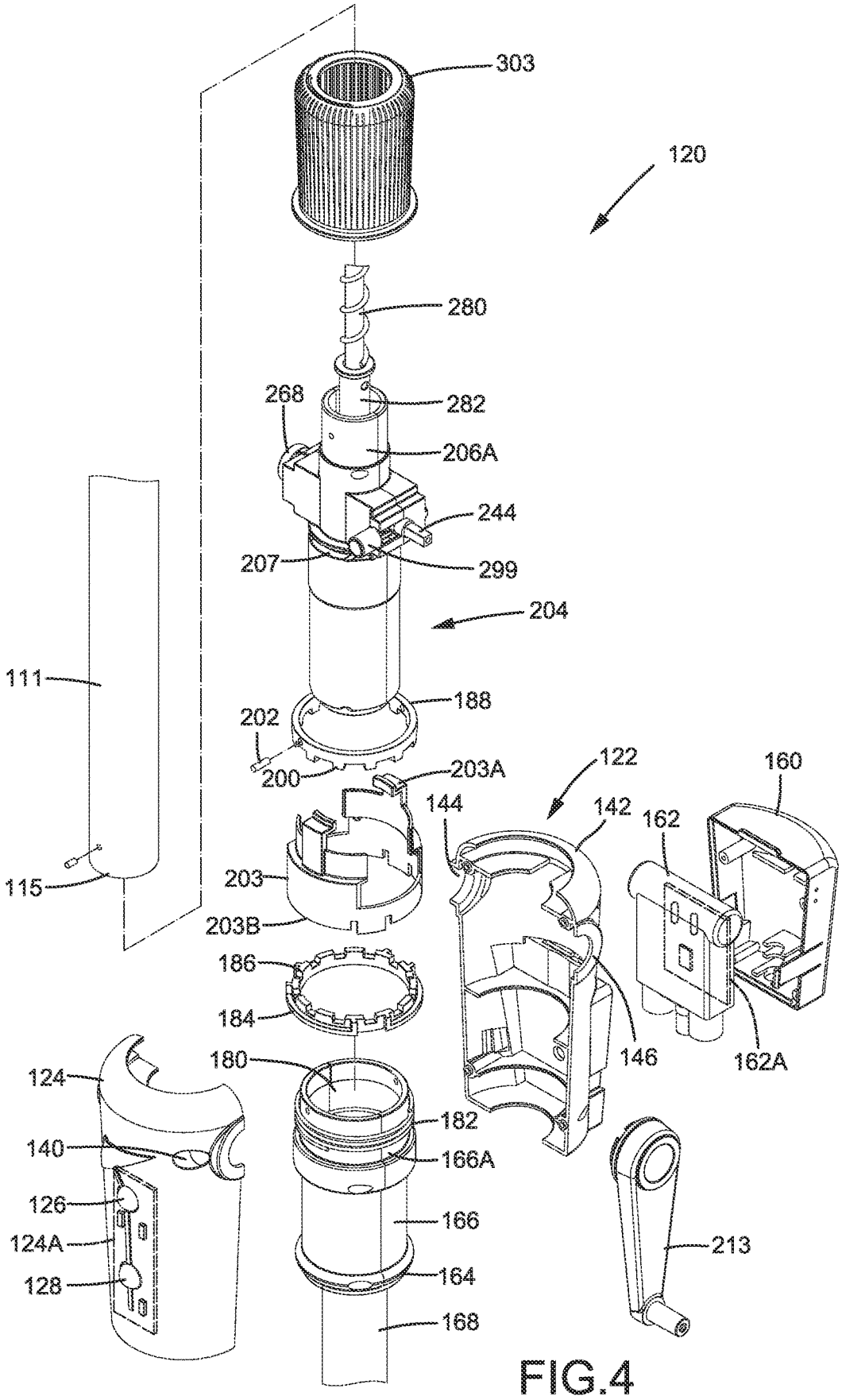
FIG. 4 is an exploded, perspective view illustrating an operating device of the sunshade of FIG. 1.
Figure 5:
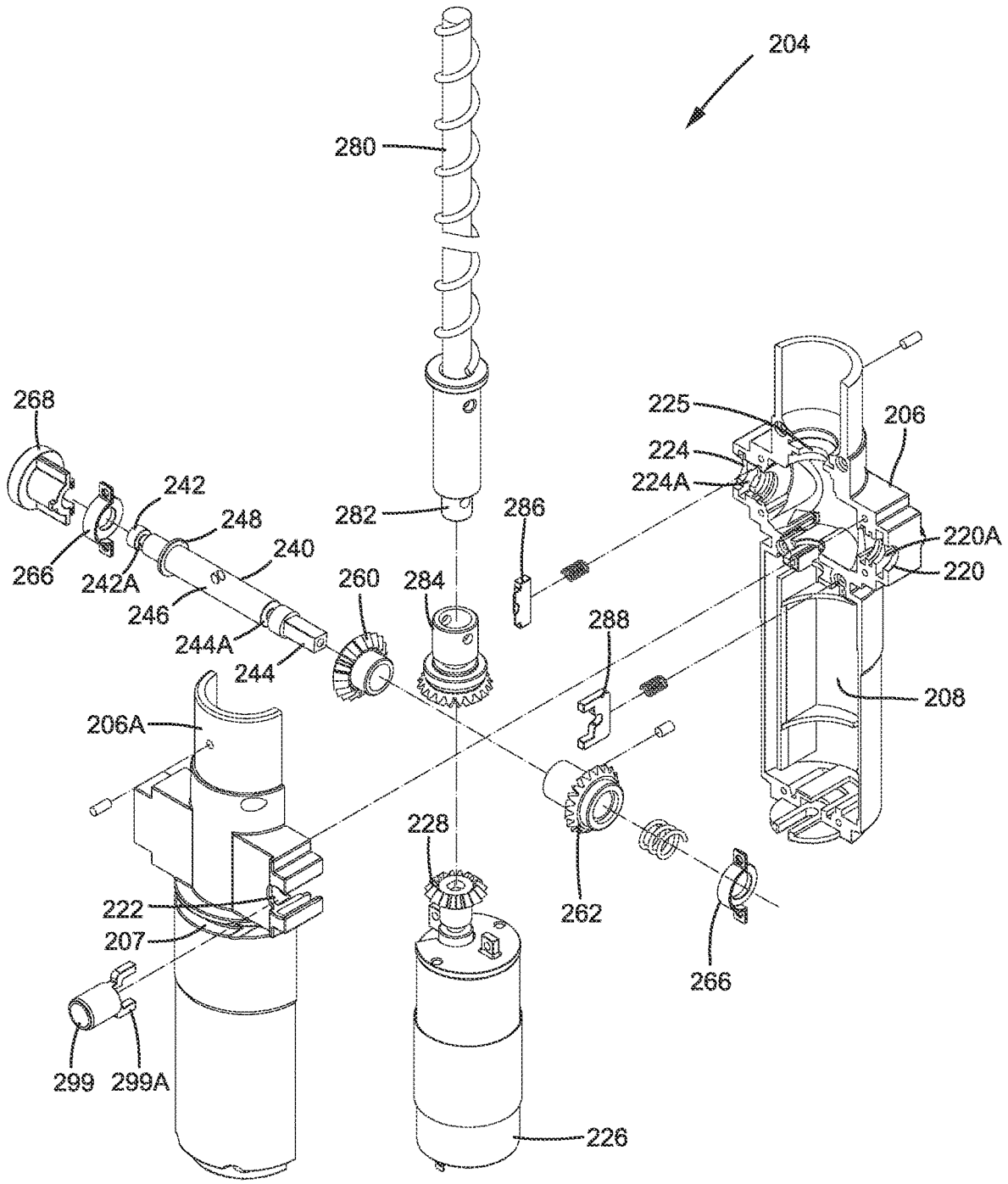
FIG. 5 is an exploded, perspective view illustrating a driving unit of the sunshade of FIG. 1.

With reference to FIGS. 1-3, a sunshade 12 according to the present invention comprises a pole 111 having upper and lower ends 113 and 115 spaced along a longitudinal axis of the pole 111. The pole 111 further includes inner and outer peripheries 114 and 112 extending between upper and lower ends 113 and 115. The inner and outer peripheries 114 and 112 are spaced from each other in a radial direction perpendicular to the longitudinal axis of the pole 111. The inner periphery 114 defines a longitudinal hole 117. A slot 119 extends from the outer periphery 112 through the inner periphery 114 in the radial direction and includes first and second ends 131 and 133. The first end 131 of the slot 119 is located between the upper end 113 of the pole 111 and the second end 133 of the slot 119 along the longitudinal axis of the pole 111.

With reference to FIGS. 4-8, the sunshade 12 further comprises an operating device 120 disposed on the lower end 115 of the pole 111. The operating device 120 includes a coupling member 164 having a rotation connection portion 166 and a coupling end 168 extending downwards from a bottom of the rotation connection portion 166. The rotation connection portion 166 includes a sleeve portion 166A at a distal end thereof and defining a space 180 extending inwards from an open end of the sleeve portion 166A. A pressing spring 182 is mounted around the sleeve portion 166A. A base 467 is fixed to the coupling end 168 of the coupling member 164.

The operating device 120 further includes a follower ring 184 and a positioning ring 188. The follower ring 184 is pivotably coupled to the sleeve portion 166A and is movable along a longitudinal axis of the sleeve portion 166A. The follower ring 184 includes a plurality of follower ring teeth 186 on an upper face thereof. The positioning sleeve 188 and the sleeve portion 166A are non-rotatably coupled to the sleeve portion 166A and are incapable of moving along the longitudinal axis of the sleeve portion 166A. Specifically, the positioning ring 188 and the sleeve portion 166A are fixed together by a pin 202 extending therethrough. The positioning ring 188 includes a plurality of positioning ring teeth 200. The pressing spring 182 biases the plurality of follower ring teeth 186 to engage with the plurality of positioning ring teeth 200, such that the follower ring 184 cannot rotate relative to the positioning ring 188 about the longitudinal axis of the sleeve portion 166A.

The operating device 120 further includes a driving unit 204 rotatably connected to the rotation connection portion 166. The driving unit 204 includes an inner casing 206 which can be comprised of two casing halves. The inner casing 206 includes a receiving portion 208 therein. The inner casing 206 further includes a shaft coupling portion 220 extending transversely above the receiving portion 208. The inner casing 206 further includes a first sliding groove 222 extending in a radial direction perpendicular to the shaft coupling portion 220 and a second sliding groove 224 coaxial to but spaced from the shaft coupling portion 220. The inner casing 206 further includes a first groove 220A defined in an inner periphery of the shaft coupling portion 220 and located corresponding to the first sliding groove 222. The inner casing 206 further includes a second groove 224A defined in an inner side of the second sliding groove 224. Each of the first groove 220A and the second groove 224A extends in a radial direction of the shaft coupling portion 220. The inner casing 206 further includes a rotation connection portion 225 above the shaft coupling portion 220 and located between the first groove 220A and the second groove 224A. The inner casing 206 further includes an assembling end 206A above the shaft coupling portion 220. The inner casing 206 further includes an outer annular groove 207 below the shaft coupling portion 220.

The driving unit 204 further includes a shaft 240 rotatably received in the inner casing 206, an actuating gear 284, a driven gear 260 for electric mode, and a driving gear 262 for manual mode. The shaft 240 includes a pressing end 242, an interlocking end 244 having non-circular cross sections, and an intermediate section 246 between the pressing end 244 and the interlocking end 244. A flange 248 is formed on an outer periphery of the intermediate section 246 and is located adjacent to the pressing end 244. The shaft 240 further includes an engaging groove 242A for manual mode located between the pressing end 242 and the flange 248 and an engaging groove 244A for electric mode between the interlocking end 244 and the flange 248. A spacing between the engaging groove 242A for manual mode and the pressing end 242 is smaller than a spacing between the engaging groove 244A for electric mode and the pressing end 242.

The shaft 240 is movable in an axial direction of the shaft coupling portion 220 and is in rotatable connection with the inner casing 206. Specifically, two bearings 266 are disposed in the shaft coupling portion 220 of the inner casing 206. The shaft 240 is rotatably coupled to the two bearings 266 and is movable between a first position in which the engaging groove 244A for electric mode is aligned with the first groove 220A and a second position in which the engaging groove 242A for manual mode is aligned with the second groove 224A. Furthermore, the driving end 244 of the shaft 240 is located outside of the inner casing 206.

Figure 6:
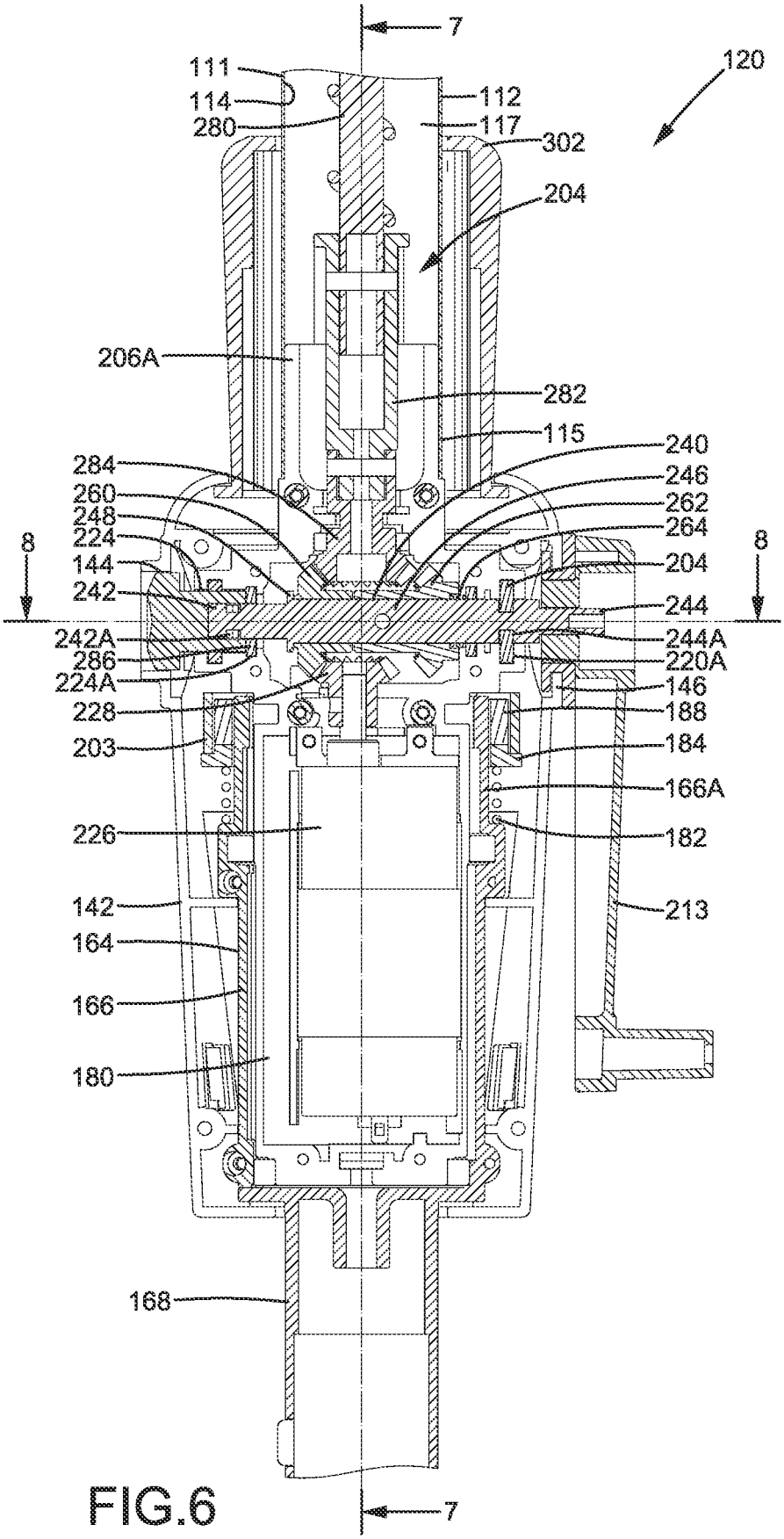
FIG. 6 is a cross sectional view taken along section line 6-6 of FIG. 1.
Figure 8:
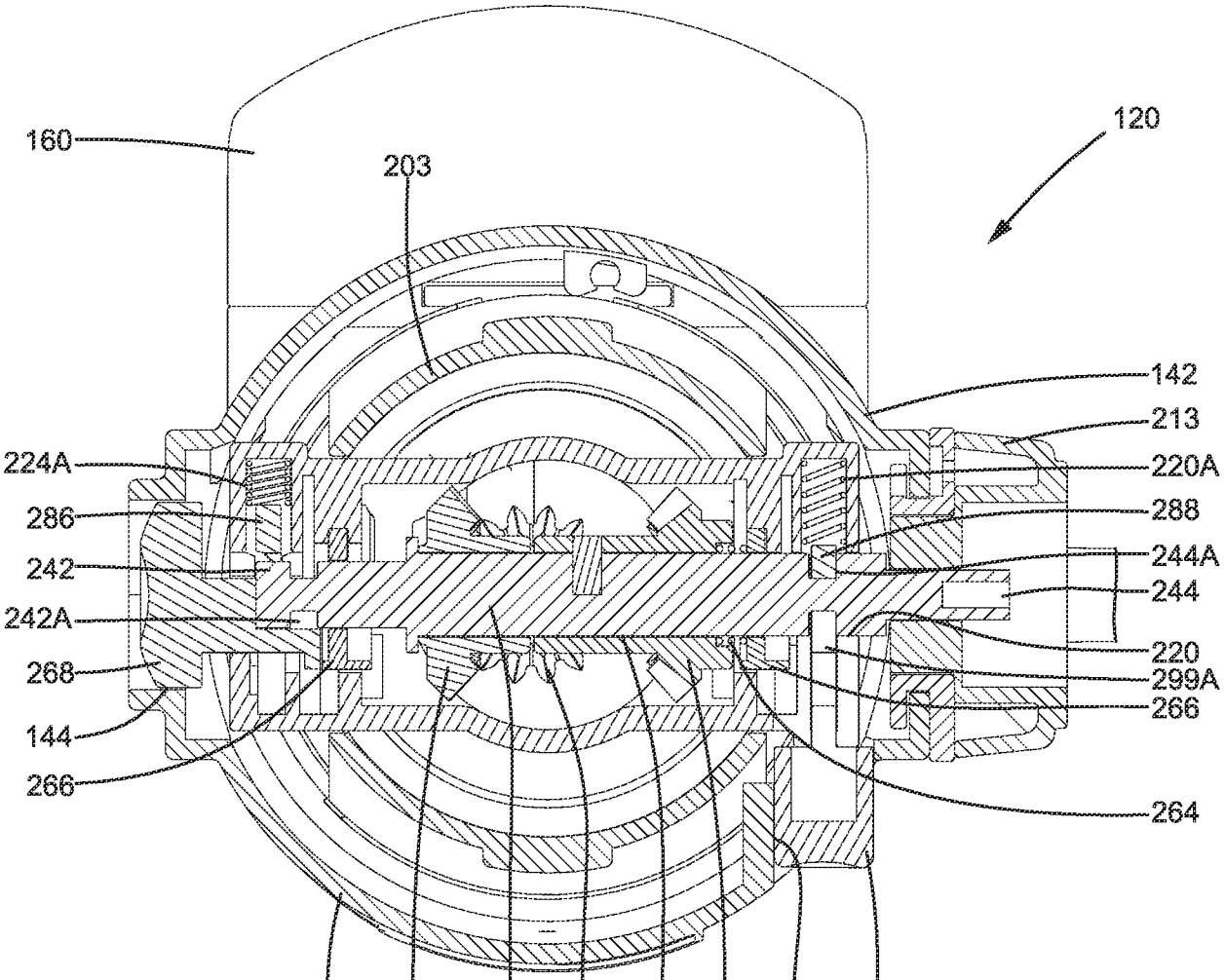
FIG. 8 is a cross sectional view taken along section line 8-8 of FIG. 6.

The driven gear 260 for electric mode is in rotatable connection with the intermediate section 246 of the shaft 240 and is adjacent to the flange 248. The driving gear 262 for manual mode is securely coupled to the intermediate section 246 of the shaft 240 and is, thus, not rotatable and not slidable relative to the shaft 240. Thus, the driven gear 260 for electric mode is located between the flange 248 and the driving gear 262 for manual mode in the axial direction of the shaft 240. A return spring 264 is disposed between the driving gear 262 for manual mode and the inner casing 206, as shown in FIGS. 6 and 8. The return spring 264 biases the driving gear 262 for manual mode towards the second sliding groove 224A.

A motor 226 is received in the receiving portion 208 of the casing 206 and includes a shaft with a driving gear 228. The driving gear 228 is located between he driven gear 260 for electric mode and the driving gear 262 for manual mode in the axial direction of the shaft 240. An actuating gear 284 is rotatably mounted to the rotation connection portion 225 of the inner casing 206 and is located between the driven gear 260 for electric mode and the driving gear 262 for manual mode. Furthermore, the actuating gear 284 is coaxial to the driving gear 228. The actuating gear 284 rotates in unison with a connecting end 282 of a screw rod 280. The screw rod 280 extends out of the inner casing 206.

The driving unit 204 further includes a switch button 299 for manual mode slidably received in the inner casing 206, a switch button 268 for electric mode, an insertion member 288 for electric mode, and an insertion member 286 for manual mode. The insertion member 288 for electric mode is movably received in the first groove 220A and is biased towards the shaft 240 by a spring. The insertion member 286 for manual mode is movably received in the second groove 224A and is biased towards the shaft 240 by another spring (see FIG. 8). The switch button 299 for manual mode includes a distal end with a substantially U-shaped pressing leg 299A. The switch button 299 for manual mode is slidably mounted in the first sliding groove 222. The pressing leg 299A abuts against the insertion member 288 for electric mode. Thus, when the switch button 299 for manual mod is pressed, the insertion member 288 for electric mode is moved. The switch button 268 for electric mode is slidably received in the second sliding groove 224 and is mounted around the pressing end 242A of the shaft 240. Thus, when the switch button 268 for electric mode is pressed, the shaft 240 moves in the axial direction of the shaft 240.

The driving unit 204 is rotatably coupled with the coupling member 164. Specifically, the receiving portion 208 of the driving unit 204 is rotatably received in the space 180 of the coupling member 164. Furthermore, a distal end of the pin 202 is located in the outer annular groove 207 of the inner casing 206, such that the driving unit 204 is incapable of disengaging from the coupling member 164 by moving in the axial direction of the coupling member 164. A connecting ring 203 is non-rotatably mounted around the outer periphery of the inner casing 206 of the driving unit 204. The connecting ring 203 includes an upper end 203A and a lower end 203B facing the follower ring 184. The lower end 203B is non-rotatably coupled to the follower ring 184. The positioning ring 188 is located inside the connecting ring 203. The connecting ring 203 can move jointly with the follower ring 184 along the longitudinal axis of the pole 111. The lower end 115 of the pole 111 is fixed to the assembling end 206A of the inner casing 206, such that the pole 111 and the driving unit 204 can rotate jointly about the longitudinal axis of the pole 111.

The operating device 120 further includes an outer casing 122 in rotatable connection with the coupling member 164. The outer casing 122 is comprised of a first casing half 124 and a second casing half 142. The first casing half 124 includes an angle adjusting button 126 on an outer face thereof and an open/close control button 128 on the outer face thereof. The first casing half 124 includes a first opening 140 corresponding to the switch button 299 for manual mode. The angle adjusting button 126 and the open/close control button 128 are used to control rotation of the motor 226 to unfold, fold, tilt, or straighten the canopy 475. Furthermore, a first circuit board 124A is mounted in the first casing half 124 and is electrically connected to the angle adjusting button 126 and the open/close control button 128.

The second casing 142 includes an engaging portion 148 on an outer side thereof. The engaging portion 148 is detachably coupled with a battery cover 160. A battery 162 is disposed between the battery cover 160 and the engaging portion 148 and is electrically connected to a second circuit board 162A. The second circuit board 162A is electrically connected to the first circuit board 124A and the motor 226. A second opening 144 is disposed between the first and second casing halves 124 and 142 and is located corresponding to the switch button 268 for electric mode. The battery 162 supplies electricity for operating the motor 226. The first and second casing halves 124 and 142 are in rotatable connection with the rotation connection portion 166. The driving unit 204 is received inside the outer casing 122. The interlocking end 244 of the shaft 240 is located outside of the outer casing 122. The switch button 299 for manual mode is received in the first opening 140. The switch button 268 for electric mode is received in the second opening 144. Furthermore, the outer casing 122 and the driving unit 204 are jointly rotatable. A handle 213 has an end coupled to the interlocking end 244 of the shaft 240 and rotatably received in the shaft coupling portion 146.

The operating device 120 further includes a push and rotate member 303 interlocked with the connecting ring 203. The push and rotate member 303 is mounted around the driving unit 204 and abuts against an upper end 203A of the connecting ring 203. The push and rotate member 303 is located outside of the outer casing 122 and is movable along the longitudinal axis of the pole 111.

According to the form shown, a canopy angle adjusting device 360 is mounted to the upper end 113 of the pole 111. The canopy angle adjusting device 360 includes a receiving tube 531 mounted around the pole 111 and slidable relative to pole 111 along the longitudinal axis of pole 111. The receiving tube 531 includes a top end 532 and a bottom end 534. The receiving tube 531 further includes inner and outer peripheries 533 and 535 extending between the top and bottom ends 532 and 534, with the inner periphery 533 spaced from the outer periphery 535 in the radial direction, and with the inner periphery 533 defining a longitudinal hole 537. A flange 536 is formed on the outer periphery 535 and located on the top end 532. First and second protruded portions 539 and 541 are formed on the outer periphery 535 and are located at bottom end 534. An engagement groove 543 is defined in the first protruded portion 539 and has a bottom wall spaced from the inner periphery 533. A slot 544 extends from the bottom wall of the engagement groove 543 through the inner periphery 533 of the receiving tube 531. A retaining portion 545 is formed on the second protruded portion 541. The longitudinal hole 537 of the receiving tube 531 receives the pole 111, with the slot 544 of the receiving tube 531 aligned with the slot 119 of the pole 111.

According to the form shown, a follower 599 is threadedly engaged with the screw rod 280. The follower 599 includes first and second faces 611 and 613 spaced from each other along the longitudinal axis of the pole 111 and an outer periphery 615 extending between the first and second faces 611 and 613. A hole 617 extends from the first face 611 to the second face 613. An engagement hole 631 is formed in outer periphery 615 but spaced from hole 617. A pin hole 619 extends from the outer periphery 615 to the hole 617. A pin 633 is fixed in the pin hole 619 and has an end received in the hole 617 of follower 599 (FIG. 3). The screw rod 280 extends through the hole 617 of the follower 599. The follower 599 is threadedly connected to the screw rod 280 through the pin 633. Rotation of the screw rod 280 causes movement of the follower 599 along the longitudinal axis of the pole 111 between a folded position, an unfolded position, and a tilted position. An example of the structure and operation of the screw rod 280 and the follower 599 is disclosed in U.S. Pat. No. 8,899,250, the entire content of which is incorporated herein by reference.

According to the form shown, an engagement member 300 is mounted in the engagement groove 543 of the receiving tube 531. The engagement member 300 includes a body 304 received in the engagement groove 543 and an insertion portion 302 extending from the body 304. The insertion portion 302 extends through the slot 544 of the receiving tube 531 and the slot 119 of the pole 111 and engages with the engagement hole 631 of the follower 599. Thus, the receiving tube 531 and the follower 599 are jointly movable between the folded position, the unfolded position, and the tilted position. The engagement member 300 prevents rotation of the follower 599 relative to the pole 111, such that rotation of the screw rod 280 merely causes movement of the follower 599 along the longitudinal axis of the pole 111.

Figure 9:
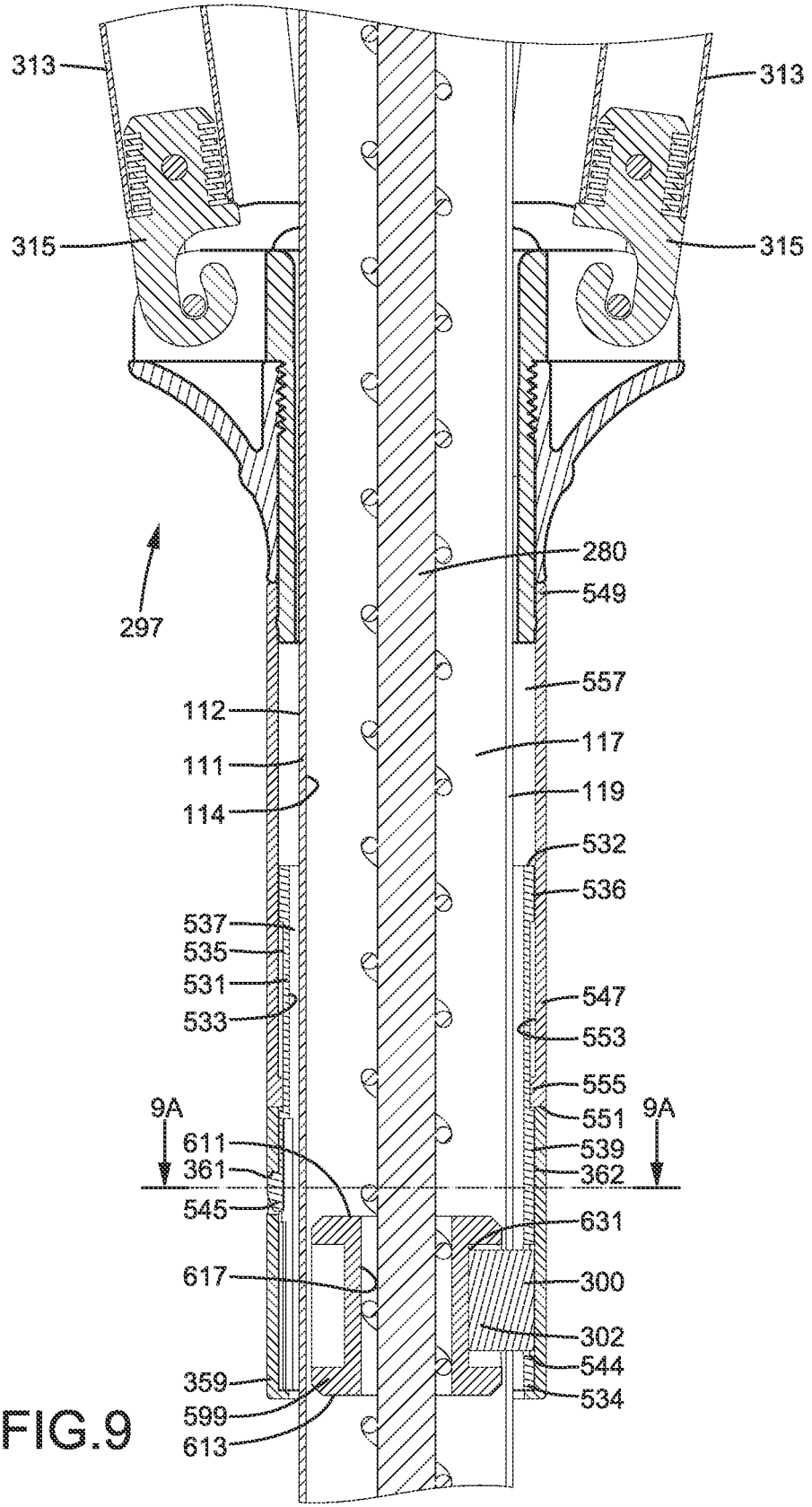
FIG. 9 is a cross sectional view taken along section line 9-9 of FIG. 1.
Figure 9A:
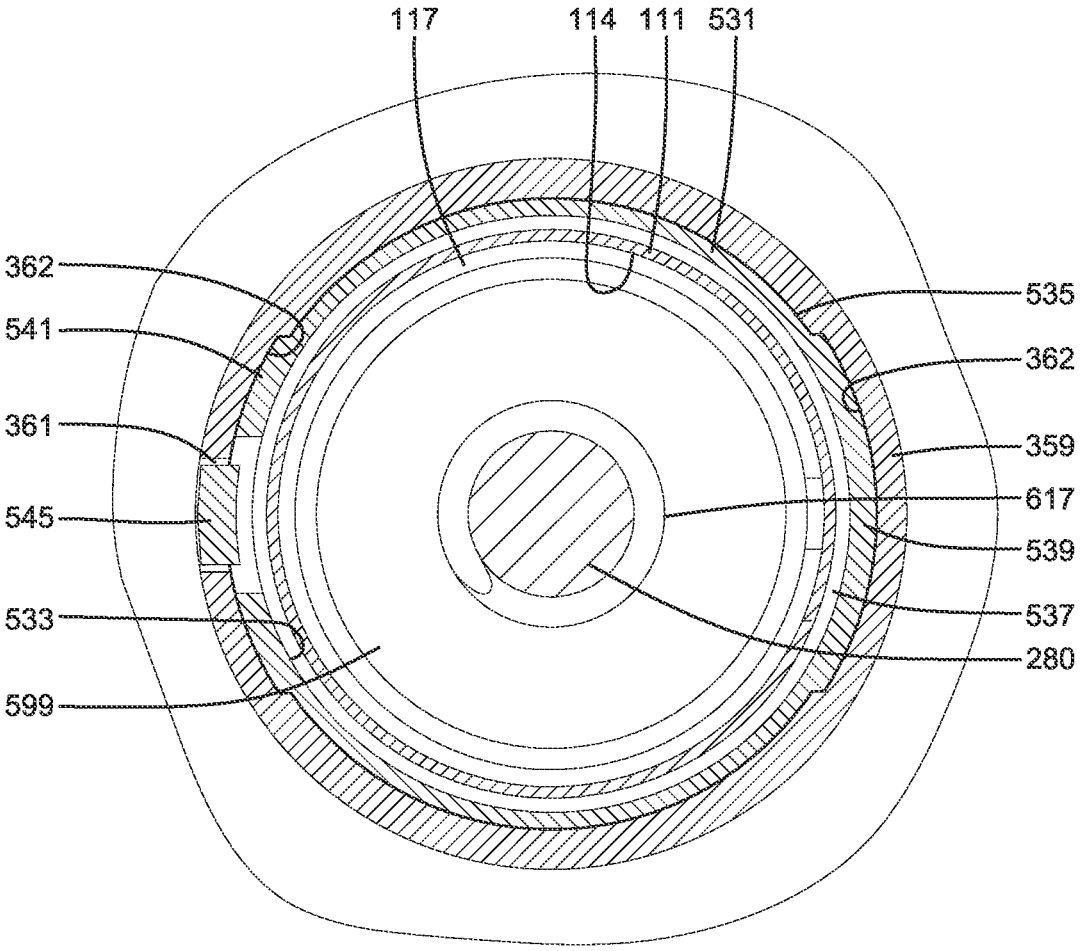
FIG. 9A is a cross sectional view taken along section line 9A-9A of FIG. 9.

According to the form shown, a fixing sleeve 359 is mounted around the bottom end 534 of the receiving tube 531 and includes two sliding grooves 362 in an inner periphery thereof and a retaining hole 361. The retaining portion 545 of the receiving tube 531 is engaged in the retaining hole 361 (FIG. 9). The first and second protruded portions 539 and 541 are received in the sliding grooves 362 (FIG. 9A), preventing the engagement member 300 from disengaging from the engagement hole 631 of the follower 599 (see FIG. 9).

According to the form shown, a sliding sleeve 547 includes an abutment end 549 and a positioning end 551 spaced from the abutment end 549 along the longitudinal axis of the pole 111. The sliding sleeve 547 further includes an inner periphery 553 extending between the abutment end 549 and the positioning end 551 and defining a sliding hole 557. Two inner protruded portions 555 are formed on the inner periphery 553 and are located at the positioning end 551. The receiving tube 531 is slidably received in the sliding hole 557 of the sliding sleeve 547. The positioning end 551 of the sliding sleeve 547 abuts an upper end of the fixing sleeve 359. Each inner protruded portion 555 is located between the flange 536 of the receiving tube 531 and the fixing sleeve 359 along the longitudinal axis of the pole 111 (see FIG. 9). Thus, each inner protruded portion 555 is movable between the flange 536 of the receiving tube 531 and the fixing sleeve 359 when the sliding sleeve 547 moves along the longitudinal axis of the pole 111.

According to the form shown, a runner 297 is mounted around the pole 111 and is slidable relative to the pole 111 along the longitudinal axis of the pole 111. A plurality of stretchers 313 is disposed on the runner 297 and is spaced from each other in a circumferential direction about the longitudinal axis of the pole 111. Each of the plurality of stretchers 313 includes a first end 315 pivotably connected to the runner 297 and a second end 317. The runner 297 is coupled with the sliding hole 557 at the abutting end 549. Thus, the runner 297, the receiving tube 531, the fixing sleeve 359, the engagement member 300, and the follower 599 move jointly between the folded position, the unfolded position, and the tilted position by operating the handle 213. When the sliding sleeve 547 moves between the flange 536 of the receiving tube 531 and the fixing sleeve 359, the runner 297 moves jointly with the sliding sleeve 547.

According to the form shown, a fixing member 363 is mounted to the upper end 113 of the pole 111 and includes a receiving section 365 having circular cross sections and a pivotal section 367, with pivotal section 367 having substantially U-shaped cross sections and having two sidewalls 368. A shoulder 369 is formed on an intersection of the receiving section 365 and the pivotal section 367. The fixing member 363 includes a compartment 371 extending from the receiving section 365 through the pivotal section 367, with the compartment 371 located between two sidewalls 368 of the pivotal section 367. Each sidewall 368 includes a sliding groove 375 in communication with the compartment 371. The sliding groove 375 of each sidewall 368 includes a first section 377 parallel to the longitudinal axis of the pole 111 and a second section 379 at an obtuse angle (about 150° in the form shown, see FIG. 10) to the first section 377. Each sidewall 368 further includes a pin hole 381 located between the sliding groove 375 and the receiving section 365. A plurality of abutment protrusions 373 is formed on an inner face of the compartment 371 and located in the receiving section 365. The receiving section 365 of the fixing member 363 is fixed in the longitudinal hole 117 at the upper end 113 of the pole 111.

According to the form shown, a pivotable member 383 is pivotably mounted to the pivotal section 367 of the fixing member 363. The pivotable member 383 includes an engaging portion 385 and a pivotal portion 387. The pivotal portion 387 includes a lower end having a lower end face 389 and an abutment face 391 at an obtuse angle (about 159° in the form shown, see FIG. 10) to the lower end face 389. The pivotal portion 387 further includes two lateral walls 388 spaced from each other in a direction perpendicular to the longitudinal axis of the pivotable member 383. A receiving space 393 is defined in the lower end face 389 and located between the two lateral walls 388 of the pivotal portion 387. Each lateral wall 388 includes a track 395 extending to the receiving space 393 in the radial direction, with the track 395 having a first track section 397 and a second track section 399 at an obtuse angle (about 135° in the form shown, see FIG. 10) to first track section 397. Each lateral wall 388 further includes a pivot hole 394 located between the track 395 and the lower end face 389. The pivotal section 367 of the fixing member 363 is received in the receiving space 393 of the pivotable member 383, with the two sidewalls 368 of the fixing member 363 located between the two lateral walls 388 of the pivotable member 383. The pivot holes 394 of the pivotable member 383 are aligned with the pin holes 381 of the fixing member 363, with the lower end face 389 of the pivotable member 383 spaced from the shoulder 369 of the fixing member 363 along the longitudinal axis of the pole 111.

Figure 14:
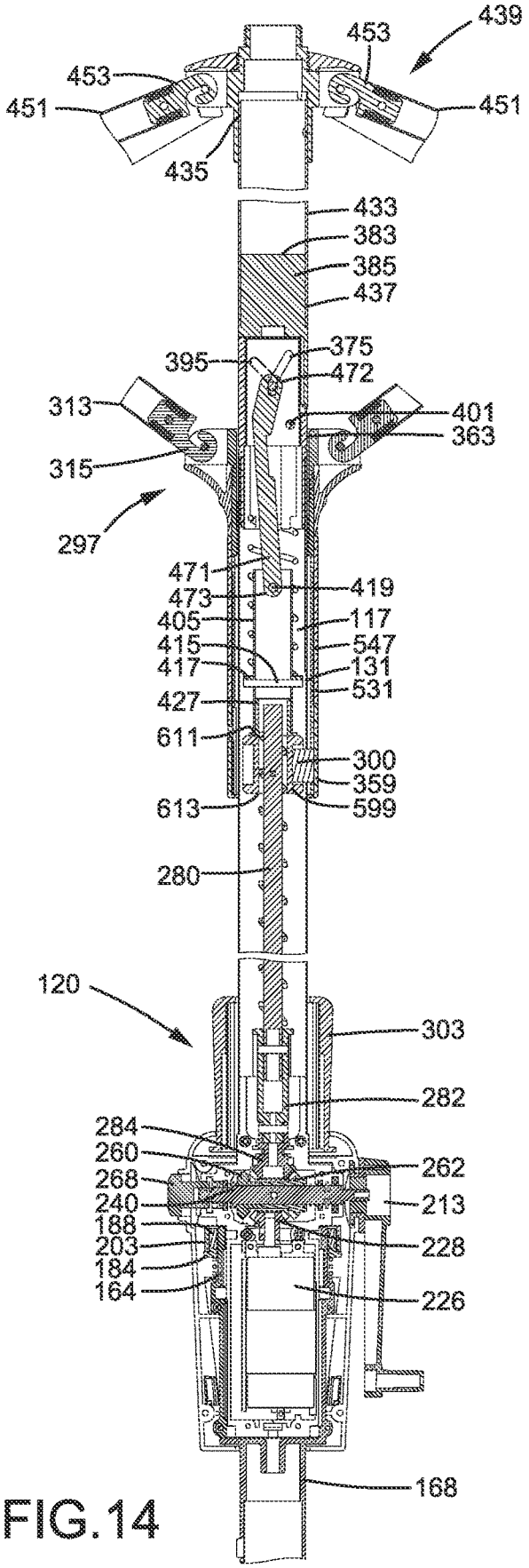
FIG. 14 is a partial, cross sectional view of the sunshade in an unfolded state.

According to the form shown, a pin 401 extends through the pivot holes 394 of the pivotable member 383 and the pin holes 381 of the fixing member 363, allowing the pivotable member 383 to pivot about a pivot axis defined by the pin 401 between a first position and a second position in a pivotal movement plane, with the pivotal movement plane being perpendicular to the pivot axis defined by the pin 401 and including the longitudinal axis of the pivotable member 383. When the pivotable member 383 is in the first position (see FIG. 10), the first track sections 397 of the tracks 395 of the pivotable member 383 are aligned with the first sections 377 of the sliding grooves 375 of the fixing member 363. Furthermore, the longitudinal axis of the pivotable member 383 is coaxial to the longitudinal axis of the pole 111. The abutment face 391 of the pivotable member 383 provides room for the pivotal movement of the pivotable member 383 from the first position to the second position. While the pivotable member 383 is moving from the first position to the second position, the lower end face 389 of the pivotable member 383 does not interfere with the shoulder 369 of the fixing member 363. On the other hand, when the pivotable member 383 is in the second position, the abutment face 391 of the pivotable member 383 is substantially parallel to the shoulder 369 of the fixing member 363 (FIG. 14). In the form shown, an extension tube 433 includes a lower end 437 fixed to the engaging portion 385 of the pivotable member 383 and an upper end 435.

Figure 10:
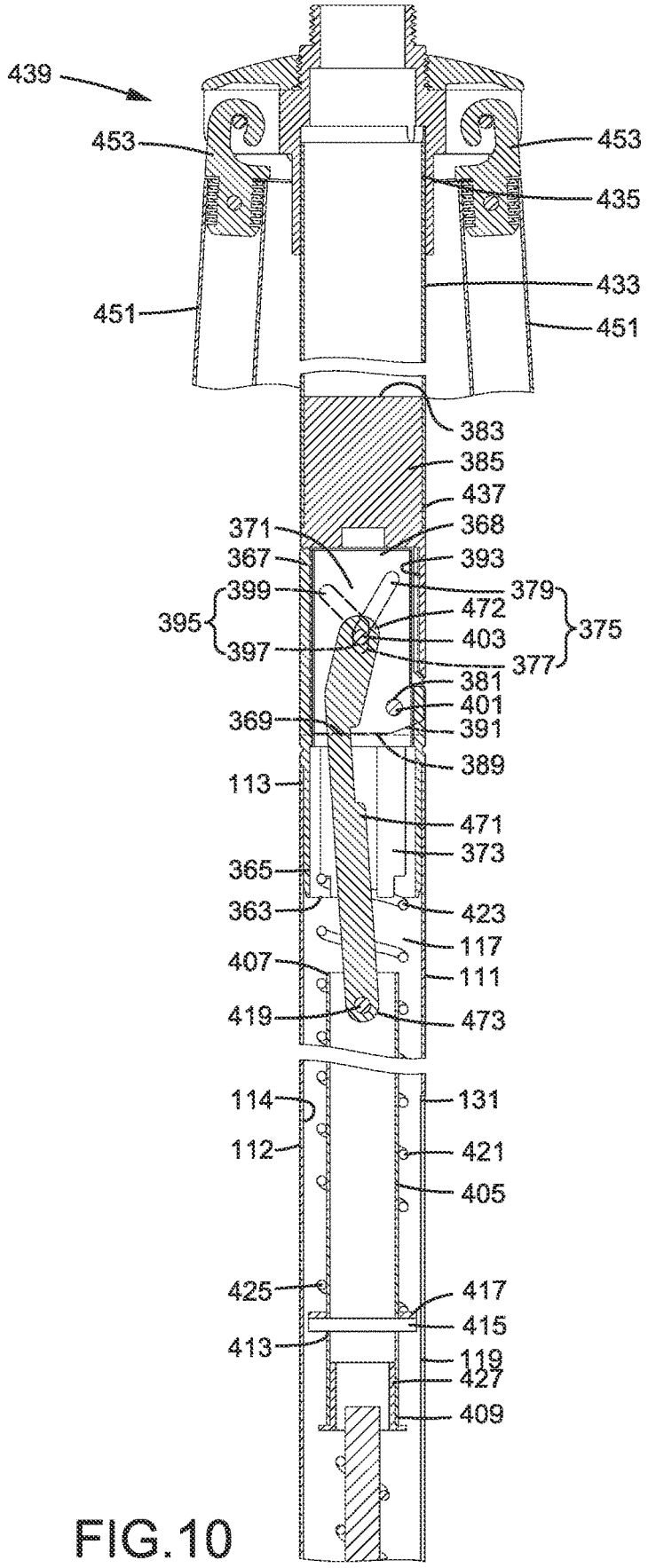
FIG. 10 is a cross sectional view taken along section line 10-10 of FIG. 1.

According to the form shown, an actuation rod 403 is slideably received in the tracks 395 of the pivotable member 383 and the sliding grooves 375 of the fixing member 363. When the pivotable member 383 is in the first position, the actuation rod 403 is in the first track sections 397 of the tracks 395 of the pivotable member 383 and the first sections 377 of the sliding grooves 375 of the fixing member 363 (FIG. 10).

According to the form shown, a link 471 includes a first connection end 472 connected to the actuation rod 403 and a second connection end 473. The first connection end 472 is received in the compartment 371 of the fixing member 363. The second connection end 473 of the link 471 is located in the longitudinal hole 117 of the pole 111. A connection member 405 includes a first end 407 pivotably connected to the second connection end 473 of the link 471 and a second end 409 below the first end 407. The connection member 405 includes aligned first positioning holes 411 defined in the first end 407 and aligned second positioning holes 413 between the second end 409 and the first positioning holes 411. A pin 419 extends through the first positioning holes 411 of the first end 407 of the connection member 405 and the second connection end 473 of the link 471. Thus, the link 471 is pivotably connected to the connection member 405. The second fixing end 593 of the helical spring 579 is received in the connection member 405. A positioning pin 415 extends through the second positioning holes 413 of the connection member 405 in a radial direction perpendicular to the longitudinal axis of the pole 111, with two ends of the positioning pin 415 located outside of the connection member 405.

According to the form shown, an abutment member 417 is annular, is mounted around the limiting member 405, and rests on exposed ends of positioning pin 415. A cap 427 includes a tubular portion 431 engaged in the second end 409 of the connection member 405. A flange 429 is formed on a lower side of the tubular portion 431 and abuts an end face of the second end 409 of the connection member 405. A spring 421 is mounted around the connection member 405 and includes a first end 423 abutting lower ends of the abutment protrusions 373 of the fixing member 363. The spring 421 further includes a second end 425 abutting the abutment member 417. The spring 421 biases the connection member 405 to retain the pivotable member 383 in the first position (FIG. 10).

According to the form shown, a hub 439 is fixed on the upper end 435 of the extension tube 433. The pivotable member 383, the extension tube 433, and the hub 439 are jointly moveable between the first and second positions about the pivot axis defined by the pin 401. A plurality of ribs 451 is provided, with each rib 451 including a connecting end 453 pivotably connected to the hub 439 (FIG. 6), with the second end 317 of each stretcher 313 pivotably connected to one of ribs 451. A canopy 475 is mounted to ribs 451.

Now that the basic construction of the sunshade 12 of the present invention has been explained, the operation and some of the advantages of the sunshade 12 can be set forth and appreciated. In particular, for the sake of explanation, it will be assumed that the follower 599 of the sunshade 12 is located in the folded position (FIG. 9). The positioning end 551 of the sliding sleeve 547 abuts the upper end of the fixing sleeve 359, preventing the runner 297 from moving away from the hub 439. The follower 599 is spaced from cap 427 along the longitudinal axis of the pole 111. The engagement member 300 is adjacent to the second end 133 of the slot 119. The runner 297 is adjacent to the outer casing 122 (FIG. 1). The longitudinal axis of the pivotable member 383 is coaxial to the longitudinal axis of the pole 111, such that the extension tube 433 is coaxial to and aligned with the pole 111. The ribs 451 and the stretchers 313 are in the folded state and located adjacent to the pole 111 so that the canopy 475 is in a collapsed state. The spring 421 biases the pivotable member 383 to the first position (FIG. 10). Thus, the sunshade 12 is in the folded state.

With reference to FIGS. 6 and 8, in a case that the operating device 120 is set to the electric mode, the engaging groove 244A for electric mode of the shaft 240 is aligned with the first groove 220A, the insertion member 288 for electric mode is engaged with the engaging groove 244A for electric mode, such that the shaft 240 cannot move in the axial direction of the shaft coupling portion 220. Furthermore, the driven gear 260 for electric mode meshes with the actuating gear 284 and the driving gear 228. The driving hear 262 for manual mode is disengaged from the actuating gear 284 and the driving gear 228.

When it is desired to open tiltable sunshade 12 in the state shown in FIGS. 9 and 10, the open/close control button 128 is pressed to activate the motor 226. The driving gear 228 drives the driven gear 260 for electric mode to rotate about the longitudinal axis of the shaft 240. Furthermore, the driven gear 260 for electric mode drives the actuating gear 284 and the screw rod 280 to rotate jointly. The threading of the screw rod 280 pushes the pin 633 to move the follower 599 from the folded position to the unfolded position and, thus, actuates the engagement member 300 to push the receiving tube 531 to thereby move the runner 297 towards the hub 439, moving the stretchers 313 and the ribs 451 to extend canopy 475.

The open/close control button 128 is so set that when it is pressed for the first time, the rotating direction (such as a forward rotation) of the motor 225 stretches open the ribs 451. In a case that the ribs 451 are opened (even though not fully opened), when the open/close control button 128 is pressed for the second time, the motor 226 rotates in a reverse direction to fold the ribs 451.

When the follower 599 reaches the unfolded position (FIG. 14), the first face 611 of the follower 599 abuts the flange 429 of the cap 427, and the runner 297 is in a location adjacent to the fixing member 363 and below the pin 401. The canopy 475 is extended by the ribs 451 and the stretchers 313. The sunshade 12 is, thus, opened.

Figure 15:
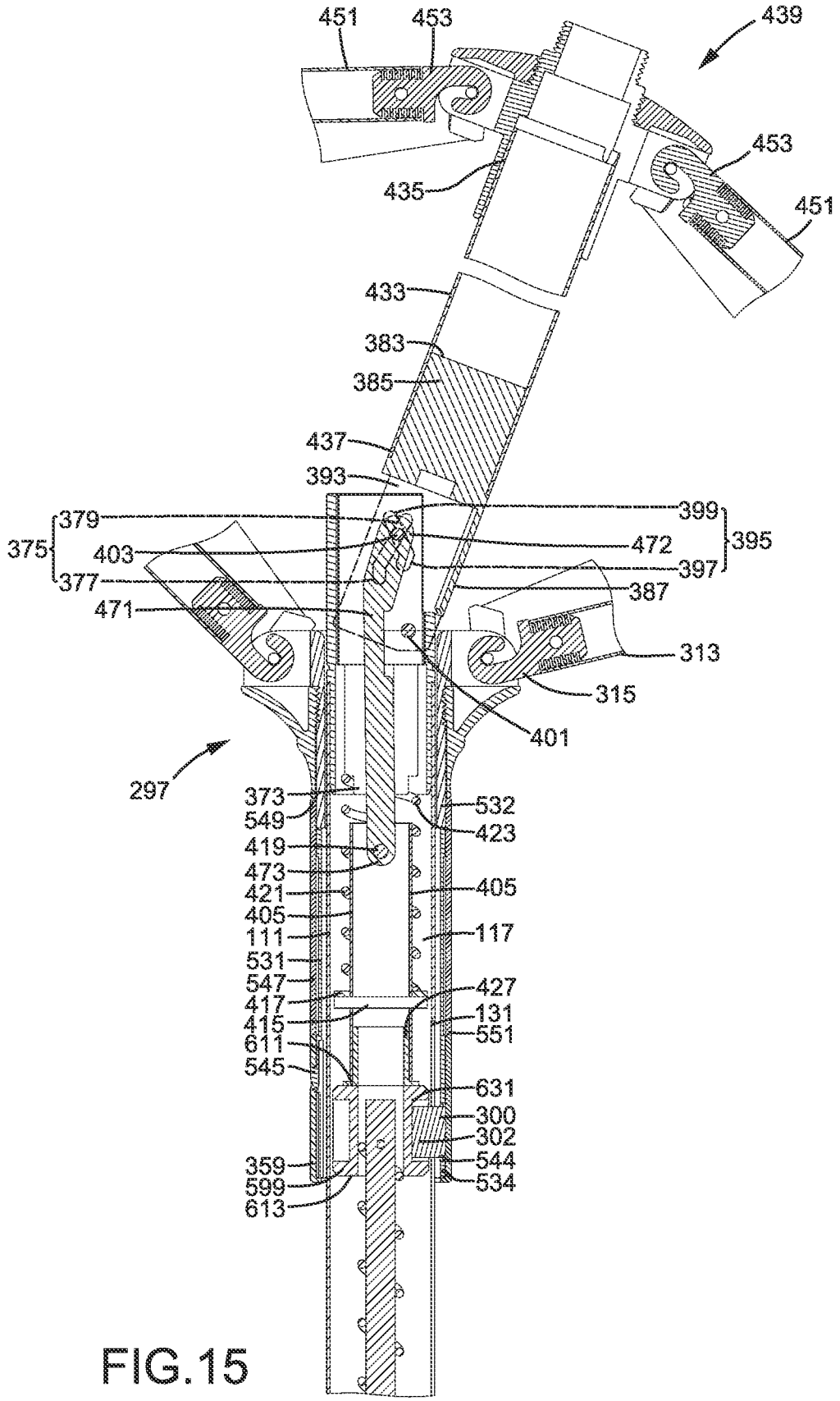
FIG. 15 is a partial, cross sectional view of the sunshade with a canopy in a tilted state.

With the sunshade 12 in the open state, when the angle adjusting button 126 is pressed, the motor 226 drives the driving gear 228 to rotate, which, in turn, moves the follower 599 from the unfolded position (FIG. 14) to the tilted position (FIG. 15). Specifically, after the follower 599 reaches the unfolded position, and the screw rod 280 continues to rotate. Thus, the follower 599 moves slowly from the unfolded position to the tilted position. The follower 599 pushes the cap 427, the connection member 405, the pin 419, the positioning pin 415, and the abutment member 417 to move along the longitudinal axis of the pole 111 and compresses the spring 421. The first connection end 472 of the link 471 pushes the actuation rod 403 to move from the first sections 377 of the sliding grooves 375 of the fixing member 363 into the second sections 379. The actuation rod 403 presses against wall faces of the tracks 395 of the pivotable member 383 to pivot the pivotable member 383 in the pivotal movement plane from the first position to the second position, leading to pivotal movement of the extension tube 433, the hub 439, and the ribs 451 to a position in which the extension tube 433 is at an obtuse angle to the pole 111. As a result, the pivotable member 383 carries the hub 439, the extension tube 433, and the ribs 451 to the second position (FIG. 15).

The angle adjusting button 126 is so set that when it is pressed for the first time, the rotating direction (such as the forward rotation) of the motor 225 moves the pivotal member 383 from the first position towards the second position (the canopy 475 tilts). In a case that the pivotal member 383 is moving towards the second position, when the angle adjusting button 126 is pressed for the second time, the motor 226 rotates in a reverse direction to move the pivotal member 383 towards the first position. When the pivotal member 383 is moving towards the second position, when the open/close control button 128 is pressed again, the motor 226 rotates in a reverse direction to move the pivotal member 383 towards the first position.

Figure 7:
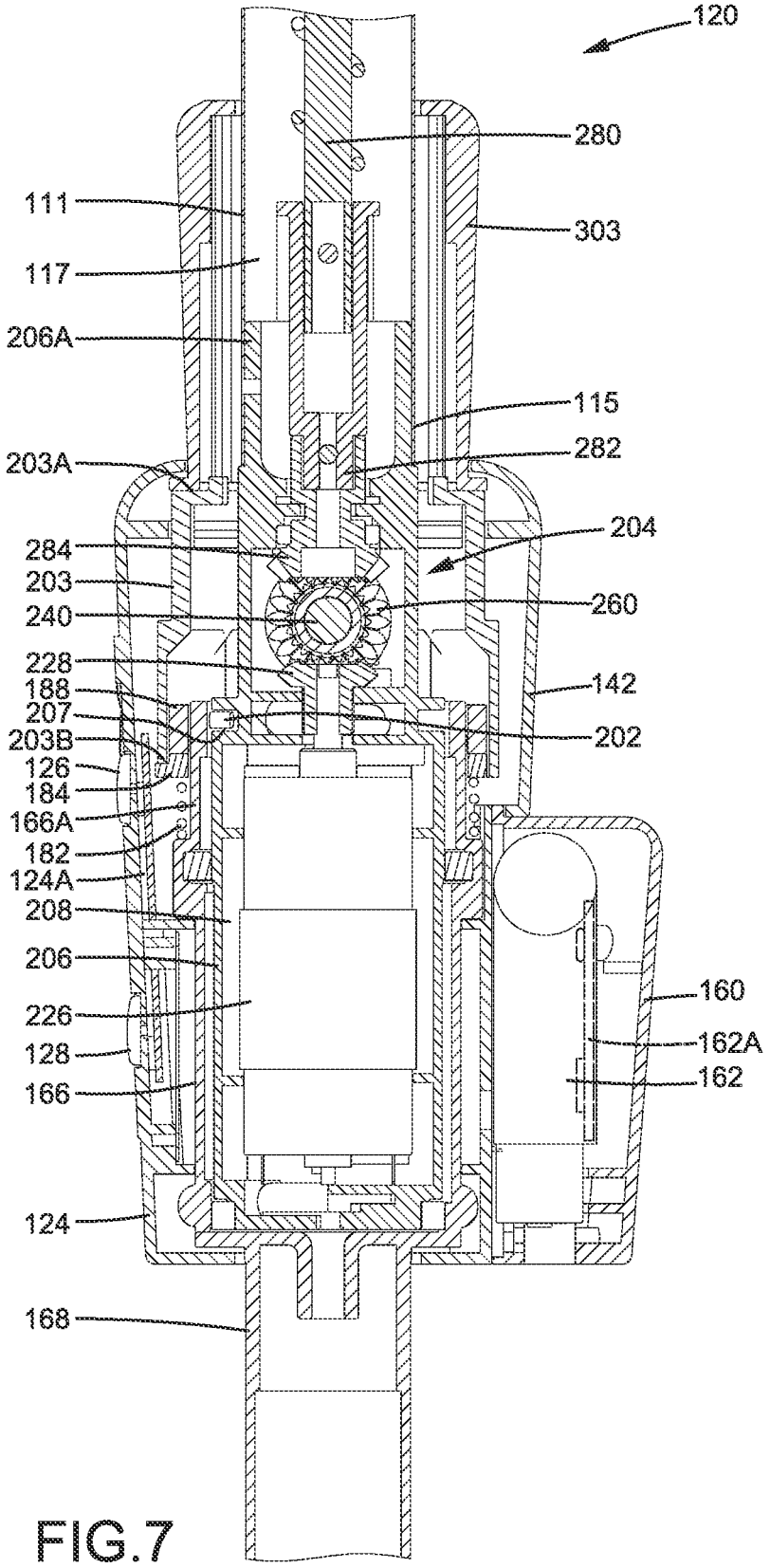
FIG. 7 is a cross sectional view taken along section line 7-7 of FIG. 6.
Figure 12:
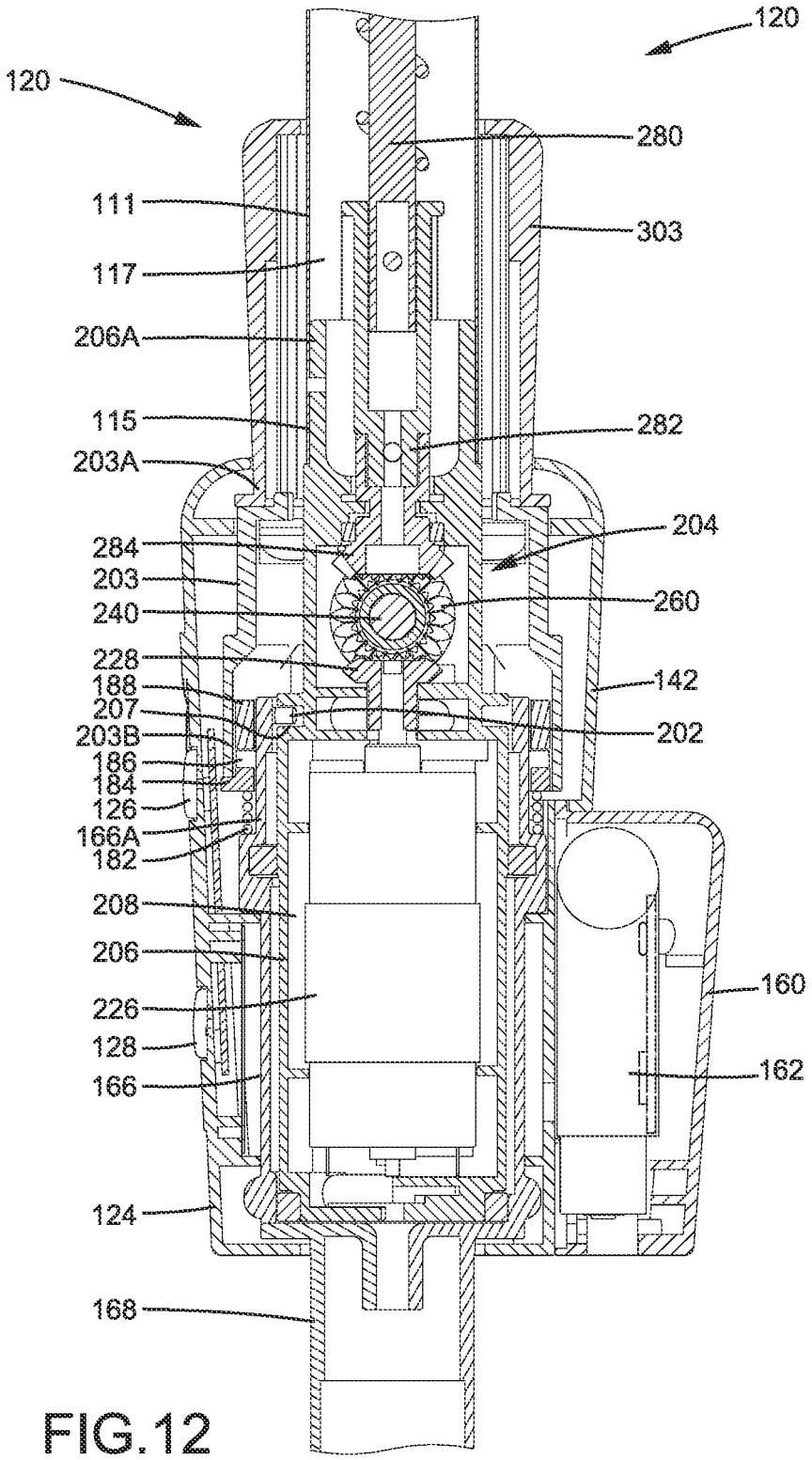
FIG. 12 is a cross sectional view similar to FIG. 7 with a follower ring disengaged from a positioning ring.

When the pivotable member 383 reaches the second position, the abutment face 391 is substantially parallel to the shoulder 369 of the fixing member 363, and the runner 297 is still located below the pin 401 along the longitudinal axis of pole 111. With reference to FIG. 7, when the canopy 475 is tilted, the follower ring 184 is biased by the pressing spring 182 to a position engaged with the positioning ring 188, which, in turn, is non-rotatably coupled to the coupling member 164 that is non-rotatably coupled to the base 467. Thus, the orientation of the canopy 475 is fixed. In a case that the canopy 475 does not face the sun, the pole 111 can be rotated to move the canopy 475 to face the sun, providing an excellent shielding effect. Rotation of the canopy 475 can be achieved by moving the push and rotate member 303 along the longitudinal axis of the pole 11, such that that connecting ring 203 pushes the follower ring 184 to move along the longitudinal axis of the pole 111 to thereby disengage from the positioning ring 188 (see FIG. 12). As a result, the operating device 120, the pole 111, the canopy angle adjusting device 360, the hub 439, and the runner 297 move jointly, thereby adjusting the canopy 475 to a position facing the sun. After the canopy 475 reaches the proper location, the push and rotate member 303 is released, and the pressing spring 182 biases the follower ring 184 to reengage with the positioning ring 188, thereby fixing the canopy 475.

When it is desired to collapse the canopy 475 of the sunshade 12, the angle adjusting button 126 is firstly pressed to actuate the motor 226 to rotate in the reverse direction, the screw rod 280 actuates the follower 599 to move from the tilted position (FIG. 15) to the unfolded position (FIG. 14). Then, the open/close control button 128 can be pressed to activate the motor 226 to rotate more quickly in the reverse direction. The screw rod 280 actuates the follower 599 to move from the unfolded position to the folded position. Thus, the canopy 475 can be folded.

Figure 13:
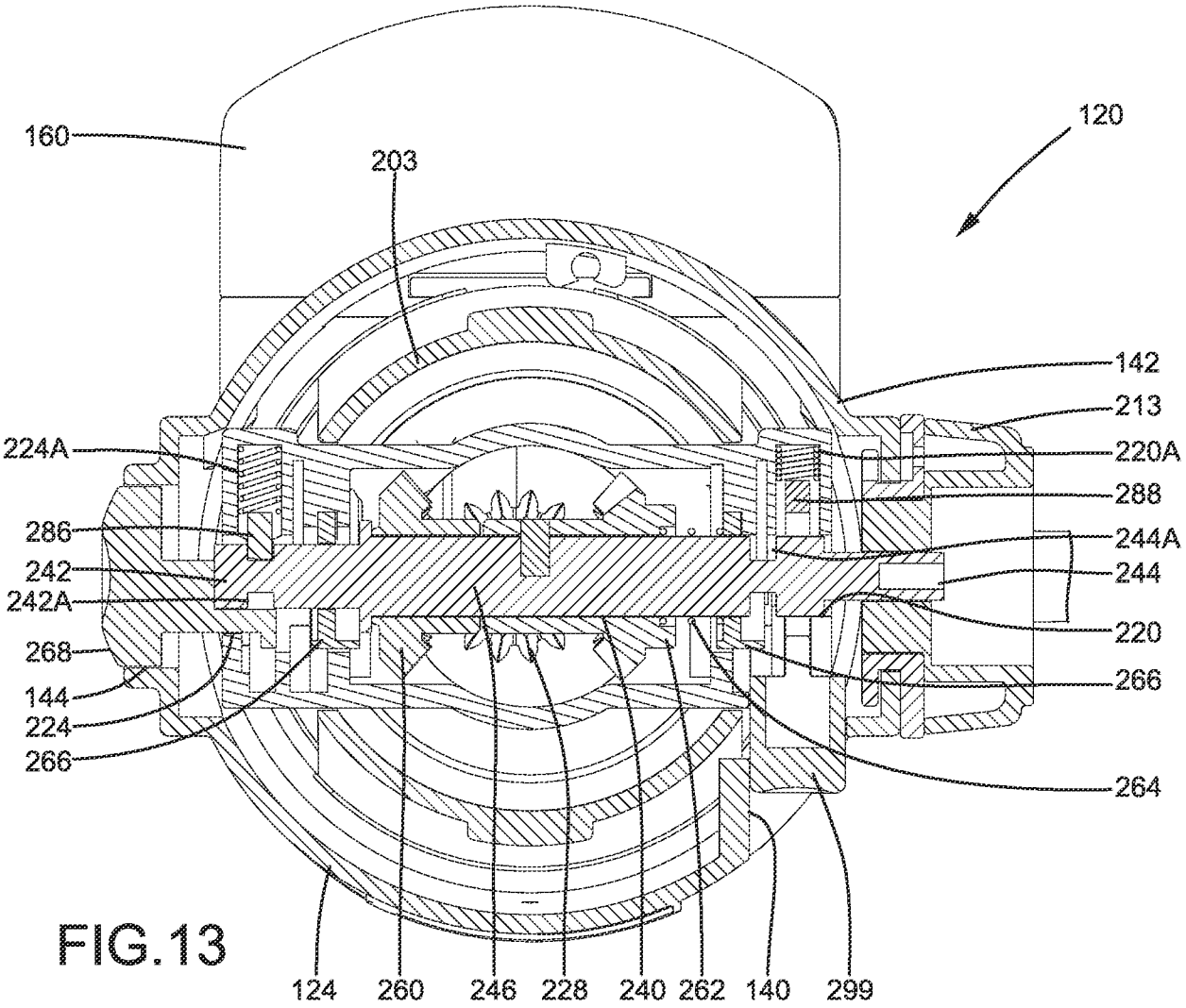
FIG. 13 is a cross sectional view taken along section line 13-13 of FIG. 11.

In addition to electric operation for folding, unfolding, tilting or straightening of the sunshade 12 by the motor 226, the sunshade 12 can be manually operated to fold, unfold, tilt, or straighten. With reference to FIG. 8, with the engaging groove 244A for electric mode of the shaft 240 engaged with the insertion member 288 for electric mode, when the switch button 299 for manual mode is pressed to disengage the insertion member 288 for electric mode from the engaging groove 244A for electric mode, the return spring 264 actuates the driving gear 262 for electric mode, the driven gear 260 for electric mode, and the switch button 268 for electric mode 268 to move jointly in the axial direction of the shaft 240 from a position in which the engaging groove 244A for electric mode is aligned with the first groove 220A to another position in which the engaging groove 242A for manual mode is aligned with the second groove 224A, as shown in FIG. 13. The insertion member 286 for manual mode engagers with the engaging groove 242A for manual mode to fix the shaft 240. The driven gear 260 for electric mode disengages from the driving gear 228 and the actuating gear 284. The driving gear 262 for manual mode meshes with the actuating gear 284. The operating device 120 is set to the manual mode.

Figure 11:
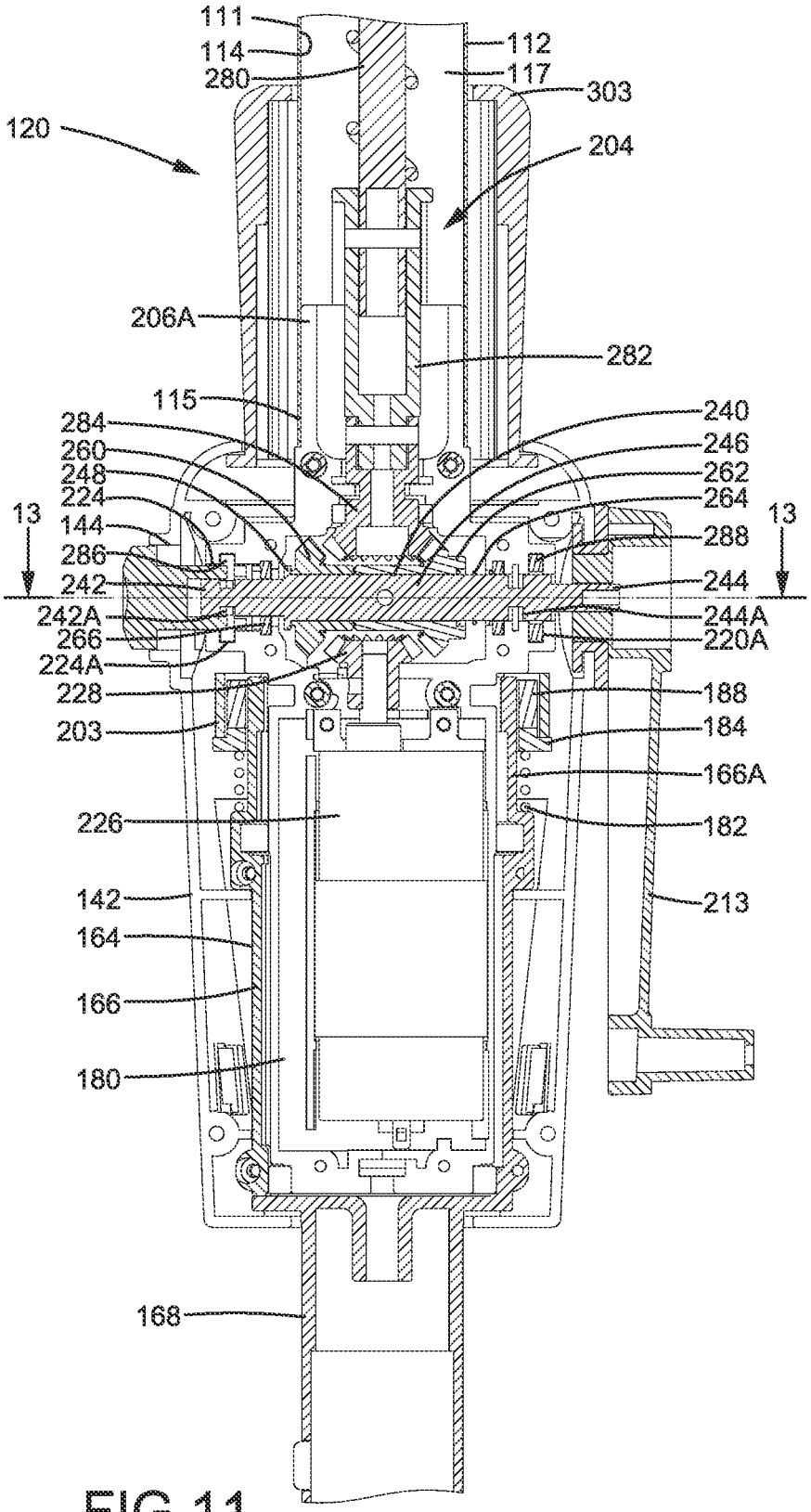
FIG. 11 is a cross sectional view similar to FIG. 6 with the operating device switched to a manual mode.

With reference to FIGS. 11 and 13, with the operating device 120 set to the manual mode, the driven gear 260 for electric mode disengages from the actuating gear 284 and the driving gear 228, such that the motor 226 cannot be used to fold, unfold, tilt, or straighten the sunshade 12. The driving gear 262 for manual mode meshes with the actuating gear 284 (but not the driving gear 228). Thus, the handle 213 can be manually operated to rotate the shaft 240 which, in turn, rotates the driving gear 262 for manual mode. Then, the actuating member 284 and the screw rod 280 are driven to rotate jointly. Namely, the handle 213 can be manually rotated to fold, unfold, tilt, or straighten the sunshade 12.

The operating device 120 can be switched between the electric mode and the manual mode. When the battery 162 has sufficient power, the motor 226 can be used to easily fold, unfold, tilt, or straighten the sunshade 12. On the other hand, when the battery 162 has insufficient power, the sunshade 12 can be manually operated to fold, unfold, tilt, or straighten the sunshade 12.

By using the push and rotate member 303, the positioning ring 188, the follower ring 184, and the coupling member 164, the canopy 475 in the tilted position can be fixed or can be adjusted to move the canopy 475 to a position facing the sun, providing an excellent shielding effect.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A sunshade switchable between a manual mode and an electric mode, comprising:

a pole including upper and lower ends spaced from each other along a longitudinal axis of the pole;

a hub securely mounted to the upper end of the pole, wherein a plurality of ribs is pivotably mounted to the hub;

a runner slidably mounted around the pole, wherein a plurality of stretchers is pivotably mounted between the runner and the plurality of ribs, wherein the plurality of ribs moves away from the pole to an unfolded position when the runner moves towards the hub, and wherein the plurality of ribs moves towards the pole to a collapsed position when the runner moves away from the hub;

a motor coupled to the lower end of the pole and configured to drive an electric mode driving gear;

a screw rod interlocked with the runner, wherein the screw rod includes a connecting end coupled to an actuating gear, and wherein rotation of the screw rod moves the runner towards or away from the hub;

a driven gear for electric mode movably and rotatably mounted between the actuating gear and the electric mode driving gear;

a manual mode driving gear movably and rotatably mounted between the actuating gear and the electric mode driving gear;

a handle interlocked with the manual mode driving gear, wherein when the sunshade is set to the electric mode, the driven gear for electric mode meshes with the actuating gear and the electric mode driving gear, the manual mode driving gear is disengaged from the actuating gear, rotation of the motor causes movement of the runner along the longitudinal axis of the pole, and the runner is not moved when the handle rotates, and wherein when the sunshade is set to the manual mode, the manual mode driving gear meshes with the actuating gear, the runner is not moved when the motor operates, and wherein rotation of the handle causes movement of the runner along the longitudinal axis of the pole.

2. The sunshade as claimed in claim 1, further comprising a shaft rotatably mounted between the actuating gear and the electric mode driving gear, wherein the shaft includes an interlocking end, wherein the driven gear for electric mode is rotatably mounted to the shaft, wherein the handle is coupled to the interlocking end of the shaft, wherein when the sunshade is set to the electric mode and the motor operates, the driven gear for electric mode rotates about an axial direction of the shaft, and the shaft and the manual mode driving gear are not moved, and wherein when the sunshade is set to the manual mode and the handle is rotated, the shaft and the manual mode driving gear rotate jointly, and the driven gear for electric mode is not moved.

3. The sunshade as claimed in claim 2, further comprising:

a return spring biasing the shaft to a position corresponding to the manual mode;

an electric mode insertion member slidably mounted around the shaft, wherein the shaft includes an electric mode engaging groove and a manual mode engaging groove;

a manual mode insertion member slidably mounted around the shaft, wherein when the sunshade is set to the electric mode, the electric mode engaging groove engages with the electric mode insertion member, and wherein when the sunshade is set to the manual mode, the manual mode engaging groove engages with the manual mode insertion member.

4. The sunshade as claimed in claim 3, wherein the shaft includes a pressing end spaced from the interlocking end and an intermediate section between the electric mode engaging groove and the manual mode engaging groove, wherein the manual mode engaging groove is adjacent to the pressing end, wherein a flange is formed on the intermediate section, wherein the manual mode driving gear and the driven gear for electric mode are formed on the intermediate section, wherein the driven gear for electric mode is retrained between the flange and the manual mode driving gear in the axial direction of the shaft, and wherein the shaft, the driven gear for electric mode, and the manual mode driving gear move jointly in the axial direction of the shaft.

5. The sunshade as claimed in claim 3, further comprising:

a canopy angle adjusting device mounted between the hub and the upper end of the pole, wherein the canopy angle adjusting device includes a pivotable member pivotable between a first position and a second position, wherein when the pivotable member is in the first position, the pivotable member and the runner are parallel to the pole, and wherein when the pivotable member is in the second position, the pivotable member and the runner are not parallel to the pole;

a base;

a coupling member coupled above the base;

an inner casing fixed to and rotatable in unison with the lower end of the pole, wherein the inner casing is rotatably coupled to the coupling member, and wherein the motor, the manual mode driving gear, the driven gear for electric mode, and the actuating gear are received in the inner casing;

a push and rotate member mounted around the inner casing and slidable along the longitudinal axis of the pole;

a positioning ring non-rotatably mounted to the coupling member; and a follower ring rotatably coupled to the coupling member and slidable along the longitudinal axis of the pole, wherein the follower ring interlocks with the push and rotate member, wherein when the follower ring engages with the positioning ring, the pole is prevented from rotating about the longitudinal axis of the pole, and wherein when the push and rotate member moves along the longitudinal axis of the pole to disengage the follower ring and the positioning ring, the pole is rotatable about the longitudinal axis of the pole.

6. The sunshade as claimed in claim 5, further comprising:

a pressing spring mounted to the coupling member and configured to bias the follower ring to engage with the positioning ring; and a connecting ring mounted between the push and rotate member and the follower ring, wherein the connecting ring is non-rotatably coupled to the inner casing, and wherein the push and rotate member presses against the connecting ring to move the follower ring.

7. The sunshade as claimed in claim 6, further comprising an outer casing in which the coupling member is rotatably mounted, wherein a battery cover is detachably mounted to the outer casing and receives a battery for supplying electricity to the motor for operation, wherein the coupling member includes a rotation connection portion and a coupling end extending from the rotation connection portion, wherein the coupling end is coupled to the base, wherein the rotation connection portion includes a sleeve portion formed at a distal end thereof and defining a space, wherein the pressing spring, the follower ring, and the connecting ring are coupled to the sleeve portion, wherein a portion of the inner casing is rotatably received in the space, wherein the outer casing is in rotatable connection with the rotation connection portion and is jointly rotatable with the inner casing, and wherein the handle is located outside of the outer casing.

8. The sunshade as claimed in claim 5, further comprising:

a manual mode switch button interlocked with the electric mode insertion member, wherein the inner casing includes a shaft coupling portion extending in a radial direction of the pole, wherein the inner casing further includes a first groove defined in an inner periphery of the shaft coupling portion and located corresponding to the electric mode engaging groove, the inner casing further includes a second groove defined in the inner periphery of the shaft coupling portion and located corresponding to the manual mode engaging groove, wherein the inner casing further includes a first sliding groove extending from the outer periphery thereof to the shaft coupling portion and located corresponding to the first groove and a second sliding groove coaxial to the shaft coupling portion, wherein the shaft is in rotatable connection with the shaft coupling portion, wherein the electric mode insertion member is movable received in the first groove, wherein the manual mode insertion member is movably received in the second groove, and wherein the manual mode switch button is movable received in the first sliding groove; and an electric mode switch button, wherein the shaft further includes a pressing end spaced from the interlocking end, wherein a spacing between the manual mode engaging groove and the pressing end is smaller than a spacing between the electric mode engaging groove and the pressing end, wherein the electric mode switch button interlocks with the pressing end of the shaft and is movably received in the second sliding groove.

9. A sunshade switchable between a manual mode and an electric mode, comprising:

a pole including upper and lower ends spaced from each other along a longitudinal axis of the pole;

a hub securely mounted to the upper end of the pole, wherein a plurality of ribs is pivotably mounted to the hub;

a runner slidably mounted around the pole, wherein a plurality of stretchers is pivotably mounted between the runner and the plurality of ribs, wherein the plurality of ribs moves away from the pole to an unfolded position when the runner moves towards the hub, and wherein the plurality of ribs moves towards the pole to a collapsed position when the runner moves away from the hub;

an operating device coupled to the lower end of the pole, wherein the operating device interlocks with the runner and includes a motor and a handle;

a canopy angle adjusting device mounted between the hub and the upper end of the pole, wherein the canopy angle adjusting device includes a pivotable member pivotable between a first position and a second position, wherein when the pivotable member is in the first position, the pivotable member and the runner are parallel to the pole, and wherein when the pivotable member is in the second position, the pivotable member and the runner are not parallel to the pole;

a base; and a coupling member fixed above the base;

wherein the operating device includes:

an inner casing coupled to and rotatable in unison with the lower end of the pole, wherein the inner casing is rotatably coupled to the coupling member;

a push and rotate member mounted around the inner casing and slidable along the longitudinal axis of the pole;

a positioning ring non-rotatably mounted to the coupling member; and a follower ring rotatably coupled to the coupling member and slidable along the longitudinal axis of the pole, wherein the follower ring interlocks with the push and rotate member, wherein when the follower ring engages with the positioning ring, the pole is prevented from rotating about the longitudinal axis of the pole, wherein when the push and rotate member moves along the longitudinal axis of the pole to disengage the follower ring and the positioning ring, the pole is rotatable about the longitudinal axis of the pole, wherein when the operating device is set to the electric mode, the rotation of the motor causes movement of the runner along the longitudinal axis of the pole, and the runner is not moved when the handle rotates, wherein when the operating device is set to the manual mode, the runner is not moved when the motor operates, and wherein rotation of the handle causes movement of the runner along the longitudinal axis of the pole.

10. The sunshade as claimed in claim 9, wherein the operating device further includes:

a pressing spring mounted to the coupling member and configured to bias the follower ring to engage with the positioning ring; and a connecting ring mounted between the push and rotate member and the follower ring, wherein the connecting ring is non-rotatably coupled to the inner casing, and wherein the push and rotate member presses against the connecting ring to move the follower ring.

11. The sunshade as claimed in claim 10, further comprising:

an outer casing in which the coupling member is rotatably mounted, wherein a battery cover is detachably mounted to the outer casing and receives a battery for supplying electricity to the motor for operation, wherein the coupling member includes a rotation connection portion and a coupling end extending from the rotation connection portion, wherein the coupling end is coupled to the base, wherein the rotation connection portion includes a sleeve portion formed at a distal end thereof and defining a space, wherein the pressing spring, the follower ring, and the connecting ring are coupled to the sleeve portion, wherein a portion of the inner casing is rotatably received in the space, wherein the outer casing is in rotatable connection with the rotation connection portion and is jointly rotatable with the inner casing, and wherein the handle is located outside of the outer casing.

* * * * *